US012642293B2

(12) United States Patent
Bagheri et al.

(10) Patent No.: US 12,642,293 B2
(45) **Date of Patent: *Jun. 2, 2026**

(54) POLYSACCHARIDE-BASED TOBACCO GEL COMPOSITIONS

(71) Applicant: JUUL Labs, Inc., Washington, DC (US)

(72) Inventors: Samira Bagheri, Mountain View, CA (US); Namhey Lee, Hayward, CA (US); Anusha Saripalli, Santa Clara, CA (US); Krishnamohan Sharma, Milpitas, CA (US)

(73) Assignee: JUUL Labs, Inc., Washington, DC (US)

( * ) Notice: Subject to any disclaimer, the term of this patent is extended or adjusted under 35 U.S.C. 154(b) by 348 days.

This patent is subject to a terminal disclaimer.

(21) Appl. No.: 18/203,082

(22) Filed: May 30, 2023

(65) Prior Publication Data

US 2023/0292814 A1 Sep. 21, 2023

Related U.S. Application Data

(63) Continuation of application No. PCT/US2021/059899, filed on Nov. 18, 2021.

(60) Provisional application No. 63/119,486, filed on Nov. 30, 2020.

(51) Int. Cl.
*A24B 15/16* (2020.01)
*A24B 15/42* (2006.01)

(52) U.S. Cl.
CPC ..... *A24B 15/42* (2013.01); *A24B 15/16* (2013.01)

(58) Field of Classification Search
None
See application file for complete search history.

(56) References Cited

U.S. PATENT DOCUMENTS

| | | | |
|---|---|---|---|
| 2,162,738 | A | 6/1939 | McCoy |
| 2,938,818 | A | 5/1960 | Specht |
| 3,012,915 | A | 12/1961 | Howard |
| 3,847,326 | A | 11/1974 | Webster |
| 3,880,172 | A | 4/1975 | Anderson et al. |

(Continued)

FOREIGN PATENT DOCUMENTS

| | | | |
|---|---|---|---|
| CA | 622523 | A | 6/1961 |
| CN | 102316850 | A | 1/2012 |

(Continued)

OTHER PUBLICATIONS

Tomas, et al., (May 26, 2017) "Laponite®: A Key Nanoplatform for Biomedical Applications?" Nanomedicine: Nanotechnology, Biology and Medicine, 14(7):2407-2420.

(Continued)

*Primary Examiner* — Eric Yaary
(74) *Attorney, Agent, or Firm* — Mintz, Levin, Cohn, Ferris, Glovsky and Popeo, P.C.

(57) ABSTRACT

Compositions include an aqueous polysaccharide-based gellant system including a polysaccharide and a gel modifier, and a tobacco material. Other compositions include a cellulose matrix, a tobacco material, and a water-soluble polymer. Still other compositions include an alginate, a tobacco material, and an alginate crosslinker. These compositions may be placed in a cartridge for use in a device for delivering nicotine to a user.

18 Claims, 3 Drawing Sheets

(56) References Cited

U.S. PATENT DOCUMENTS

| | | | | |
|---|---|---|---|---|
| 4,147,172 | A | 4/1979 | Calder et al. | |
| 5,525,351 | A | 6/1996 | Dam | |
| 6,344,222 | B1 | 2/2002 | Cherukuri et al. | |
| 7,040,314 | B2 | 5/2006 | Nguyen et al. | |
| 7,581,540 | B2 | 9/2009 | Hale et al. | |
| 8,356,606 | B2 | 1/2013 | Sengupta et al. | |
| 8,402,978 | B2 | 3/2013 | Karles et al. | |
| 8,485,180 | B2 | 7/2013 | Smutney et al. | |
| 8,741,348 | B2 | 6/2014 | Hansson et al. | |
| 8,893,724 | B2 | 11/2014 | Woodcock et al. | |
| 10,195,345 | B2 | 2/2019 | Senior et al. | |
| 10,328,443 | B2 | 6/2019 | Ricketts et al. | |
| 10,609,958 | B2 | 4/2020 | Robinson et al. | |
| 10,856,573 | B2 | 12/2020 | Pijnenburg et al. | |
| 10,952,452 | B2 | 3/2021 | Sengupta et al. | |
| 11,053,395 | B2 | 7/2021 | Karles et al. | |
| 11,246,344 | B2 | 2/2022 | Griffith, Jr. et al. | |
| 11,259,569 | B2 | 3/2022 | Hejazi | |
| 2005/0056294 | A1 | 3/2005 | Wanna et al. | |
| 2006/0032501 | A1* | 2/2006 | Hale | A61M 15/0031 128/203.12 |
| 2006/0171990 | A1 | 8/2006 | Asgari | |
| 2006/0191548 | A1 | 8/2006 | Strickland et al. | |
| 2010/0006092 | A1 | 1/2010 | Hale et al. | |
| 2011/0083681 | A1 | 4/2011 | Sengupta et al. | |
| 2011/0232657 | A1 | 9/2011 | Karles et al. | |
| 2012/0152264 | A1 | 6/2012 | Coleman et al. | |
| 2012/0199149 | A1 | 8/2012 | Strickland et al. | |
| 2013/0186418 | A1* | 7/2013 | Gao | A24B 15/30 131/359 |
| 2013/0255702 | A1 | 10/2013 | Griffith, Jr. et al. | |
| 2015/0013693 | A1 | 1/2015 | Fuisz et al. | |
| 2015/0068545 | A1 | 3/2015 | Moldoveanu et al. | |
| 2016/0136153 | A1 | 5/2016 | Jenkins | |
| 2016/0295910 | A1 | 10/2016 | Besso et al. | |
| 2017/0071249 | A1 | 3/2017 | Ampolini et al. | |
| 2017/0099877 | A1 | 4/2017 | Worm et al. | |
| 2017/0251714 | A1 | 9/2017 | Mishra et al. | |
| 2017/0265517 | A1 | 9/2017 | Swede et al. | |
| 2017/0340005 | A1 | 11/2017 | Terao | |
| 2018/0029782 | A1 | 2/2018 | Zuber et al. | |
| 2018/0042302 | A1 | 2/2018 | Robinson et al. | |
| 2018/0084823 | A1 | 3/2018 | Fuisz et al. | |
| 2018/0199617 | A1 | 7/2018 | Iodice | |
| 2018/0228203 | A1 | 8/2018 | Pithawalla et al. | |
| 2018/0310624 | A1 | 11/2018 | Parker et al. | |
| 2019/0183177 | A1 | 6/2019 | Hubbard et al. | |
| 2021/0177039 | A1* | 6/2021 | Yao | A61K 9/007 |
| 2021/0315257 | A1 | 10/2021 | Aoun et al. | |
| 2022/0211092 | A1 | 7/2022 | Arafat Arafat | |
| 2022/0312841 | A1 | 10/2022 | Diokno et al. | |
| 2024/0260654 | A1* | 8/2024 | Ashraf | A24F 40/10 |

FOREIGN PATENT DOCUMENTS

| | | | |
|---|---|---|---|
| CN | 108277085 | A | 7/2018 |
| CN | 108366614 | A | 8/2018 |
| CN | 109105944 | A | 1/2019 |
| CN | 109310622 | A | 2/2019 |
| CN | 111685388 | A | 9/2020 |
| EP | 0135265 | A2 | 3/1985 |
| EP | 0405190 | A2 | 1/1991 |
| EP | 0509657 | A1 | 10/1992 |
| EP | 0419974 | B1 | 12/1996 |
| EP | 2077731 | B1 | 8/2011 |
| EP | 2205105 | B1 | 9/2012 |
| EP | 2645886 | B1 | 4/2015 |
| EP | 2753197 | B1 | 9/2015 |
| EP | 2552237 | B1 | 10/2016 |
| EP | 2844088 | B1 | 11/2016 |
| EP | 2741625 | B1 | 4/2017 |
| EP | 2811849 | B1 | 4/2018 |
| EP | 2552248 | B1 | 9/2019 |
| EP | 2632562 | B1 | 8/2020 |
| EP | 3089602 | B1 | 9/2020 |
| EP | 3110264 | B1 | 9/2020 |
| EP | 3481237 | B1 | 9/2020 |
| EP | 3297460 | B1 | 12/2020 |
| EP | 3110265 | B1 | 2/2021 |
| EP | 3240442 | B1 | 2/2022 |
| EP | 3240439 | B1 | 6/2022 |
| EP | 3911390 | B1 | 10/2022 |
| EP | 3846643 | B1 | 11/2022 |
| EP | 3846644 | B1 | 11/2022 |
| EP | 3860376 | B1 | 5/2023 |
| GB | 1484573 | A | 9/1977 |
| KR | 10-2016-0004298 | A | 1/2016 |
| KR | 10-2019-0083314 | A | 7/2019 |
| WO | WO-9312675 | A2 | 7/1993 |
| WO | WO-9520330 | A1 | 8/1995 |
| WO | WO-9530411 | A1 | 11/1995 |
| WO | WO-2005007068 | A1 | 1/2005 |
| WO | WO-2012026963 | A2 | 3/2012 |
| WO | WO-2012134380 | A1 | 10/2012 |
| WO | WO-2013030202 | A1 | 3/2013 |
| WO | WO-2015179388 | A1 | 11/2015 |
| WO | WO-2015193242 | A2 | 12/2015 |
| WO | WO-2015197674 | A1 | 12/2015 |
| WO | WO-2017046363 | A1 | 3/2017 |
| WO | WO-2017075975 | A1 | 5/2017 |
| WO | WO-2018122375 | A1 | 7/2018 |
| WO | WO-2018224339 | A1 | 12/2018 |
| WO | WO-2019015339 | A1 | 1/2019 |
| WO | WO-2019048880 | A1 | 3/2019 |
| WO | WO-2019071910 | A1 | 4/2019 |
| WO | WO-2019086859 | A1 | 5/2019 |
| WO | WO-2019129843 | A1 | 7/2019 |
| WO | WO-2019193209 | A1 | 10/2019 |
| WO | WO-2019193311 | A1 | 10/2019 |
| WO | WO-2020025718 | A1 | 2/2020 |
| WO | WO-2021026443 | A1 | 2/2021 |

OTHER PUBLICATIONS

Chan, et al. (May 2009), Prediction Models for Shape and Size of ca-Alginate Macrobeads Produced Through Extrusion-Dripping Method, Journal of Colloid and Interface Science 338(1):63-72.

* cited by examiner

POLYSACCHARIDE-BASED TOBACCO GEL COMPOSITIONS

CROSS REFERENCE TO RELATED APPLICATIONS

The present application is a continuation application, filed under 35 U.S.C. § 120, of PCT International Patent Application No. PCT/US2021/059899 with an International Filing Date of Nov. 18, 2021, and entitled "POLYSACCHARIDE-BASED TOBACCO GEL COMPOSITIONS," which claims priority to U.S. Provisional Patent Application No. 63/119,486, on Nov. 30, 2020, and entitled "POLYSACCHARIDE-BASED TOBACCO GEL COMPOSITIONS," the disclosures of all of which is incorporated herein by reference in their entirety, to the extent permitted.

BACKGROUND

The present disclosure relates to compositions for use in electronic vapor devices. In particular, the present disclosure relates to polysaccharide-based gel compositions and their use in electronic vapor devices.

Vaporizer devices, which can also be referred to as vaporizers, electronic vaporizer devices or e-vaporizer devices, can be used for delivery of an aerosol (or "vapor") containing one or more active ingredients by inhalation of the aerosol by a user of the vaporizing device. For example, electronic nicotine delivery systems (ENDS) include a class of vaporizer devices that are battery powered and that may be used to simulate the experience of smoking, but without burning of tobacco or other substances.

In use of a vaporizer device, the user inhales an aerosol, commonly called vapor, which may be generated by a heating element that vaporizes (e.g., causing a liquid or solid to at least partially transition to the gas phase) a vaporizable material, which may be liquid, a solution, a solid, a wax, or any other form as may be compatible with use of a specific vaporizer device. The vaporizable material used with a vaporizer can be provided within a cartridge (e.g., a separable part of the vaporizer that contains the vaporizable material in a reservoir) that includes a mouthpiece (e.g., for inhalation by a user).

A typical approach by which a vaporizer device generates an inhalable aerosol from a vaporizable material involves heating the vaporizable material in a vaporization chamber (or a heater chamber) to cause the vaporizable material to be converted to the gas (or vapor) phase. A vaporization chamber generally refers to an area or volume in the vaporizer device within which a heat source (e.g., conductive, convective, and/or radiative) causes heating of a vaporizable material to produce a mixture of air and vaporized vaporizable material to form a vapor for inhalation by a user of the vaporization device.

Various vaporizable materials having a variety of contents and proportions of such contents can be contained in the cartridge. Some vaporizable materials, for example, may have a smaller percentage of active ingredients per total volume of vaporizable material, such as due to regulations requiring certain active ingredient percentages. As a result, a user may need to vaporize a large amount of vaporizable material (e.g., compared to the overall volume of vaporizable material that can be stored in a cartridge) to achieve a desired effect.

SUMMARY

In some aspects, embodiments herein relate to compositions that include an aqueous polysaccharide-based gellant system including a polysaccharide and a gel modifier, and a tobacco material.

In some aspects, embodiments herein relate to compositions that include a cellulose matrix, a tobacco material, and a water-soluble polymer.

In some aspects, embodiments herein relate to compositions that include an alginate, a tobacco material, and an alginate crosslinker.

The foregoing compositions may be placed in a cartridge for use in a device for delivering nicotine to a user.

BRIEF DESCRIPTION OF THE DRAWINGS

FIG. 1 shows a model of crosslinking of alginate mediated by crosslinking metal ions calcium (example shown), magnesium, barium, strontium and the like.

DETAILED DESCRIPTION

Figure 1:
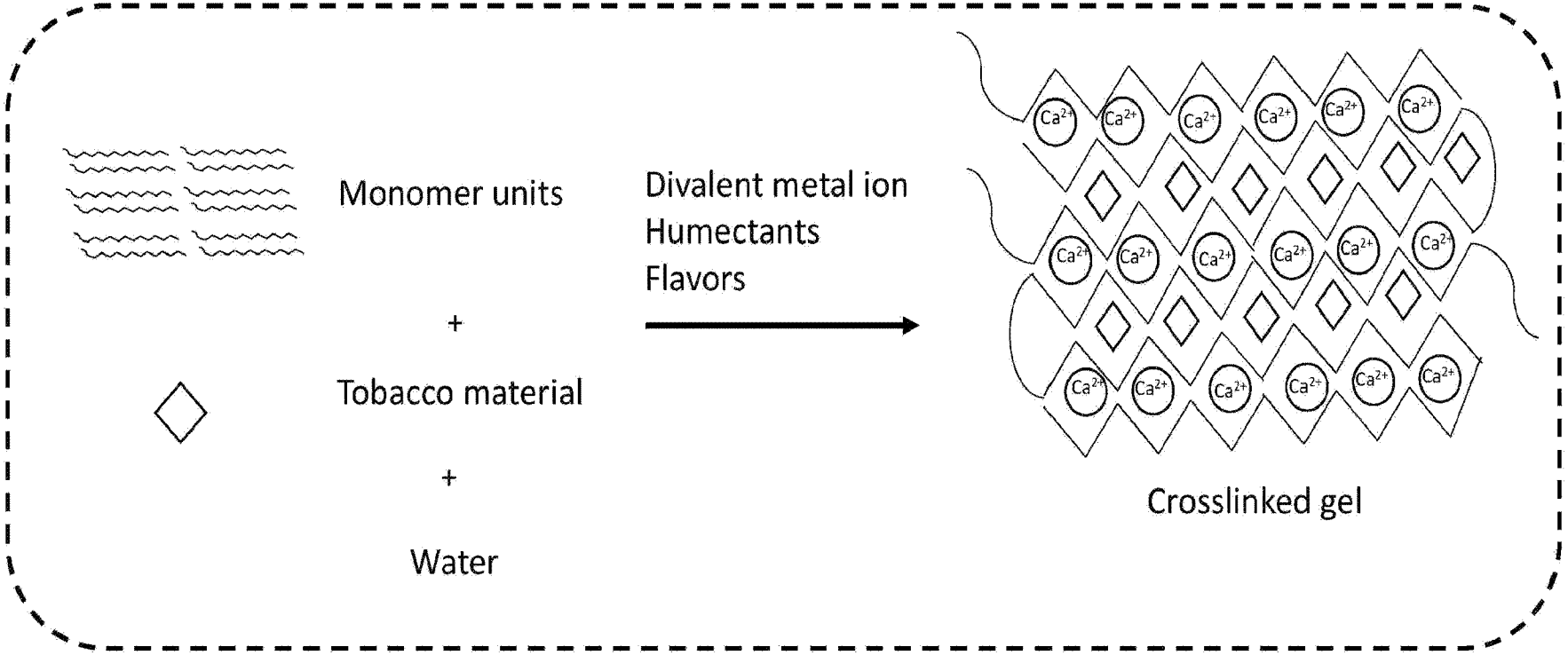

Embodiments herein provide compositions comprising polysaccharide-based gellant systems that permit the immobilization and/or encapsulation of tobacco materials within the polysaccharide polymer matrix. In embodiments, compositions are useful when used in connection with a device that heats the composition to deliver nicotine or its salt to a user. In embodiments, the gellant systems provide an opportunity to move away from typical PG/VG based carriers by reducing or eliminating PG/VG and using water as a primary carrier. In embodiments, the use of water-based carriers can significantly lower the operating temperature of the devices that heat the compositions. Such reduction in operating temperatures may improve battery life and facilitate reducing device size. Polysaccharides are often used in pharmaceutical applications and bio- or food technology and many are classified as "generally regarded as safe" (GRAS) materials.

In embodiments, the gellant systems described herein may allow for control of nicotine concentration per unit weight of composition in readily portionable quantities enabling precise dosage control. In embodiments, the viscosity of the gellant systems can be readily tuned, including by way of controlling the concentration of the gellant system components (both the polysaccharides and gel modifiers). Such control of viscosity may allow for a gellant system that prevents or greatly reduces problems of leakage encountered when employing liquids in vapor devices.

As semi-solids, the gellant compositions disclosed herein may also provide new storage opportunities, such as moving away from the use of disposable cartridges, thereby reducing waste. Those skilled in the art will appreciate these and other advantages of the embodiments disclosed herein.

Definitions

As used herein "a," "an," or "the" not only include aspects with one member, but also include aspects with more than one member. For instance, the singular forms "a," "an," and "the" include plural referents unless the context clearly dictates otherwise. Thus, for example, reference to "a polysaccharide" includes a plurality of such polysaccharides and reference to "the crosslinker" includes reference to or other gel modifiers, which may include, for example, one or more crosslinkers, known to those skilled in the art, and so forth.

As used herein, the term "about," is intended to qualify the numerical values that it modifies, denoting such a value as variable within a margin of error. When no particular margin of error is assigned, such as a standard deviation to a mean value, the term "about" should be understood to mean that range which would encompass the recited value and the range which would be included by rounding up or down to that figure, taking into account significant figures.

As used herein, "gel" is used in accordance with its ordinary meaning. The IUPAC provides guidance: a gel is a non-fluid colloidal network or polymer network that is expanded through its whole volume by a fluid. *IUPAC. Compendium of Chemical Terminology,* 2nd ed. (the "Gold Book"). Compiled by A. D. McNaught and A. Wilkinson. Blackwell Scientific Publications, Oxford (1997). The gels disclosed herein are polysaccharide based and typically are formed via crosslinking and/or physical aggregation of polymer chains. A gel network is typically characterized as having regions of local order. In aqueous media, the gel is typically referred to as a "hydrogel." This contrasts with gels in organic solvent systems "organogels" or where solvent is substantially removed, "xerogels."

As used herein, "polysaccharide-based gellant system" refers to a chemical gel system having at least two components. The first component is a polysaccharide compound (e.g. structure) capable of forming a gel either on its own or with the aid of a secondary additive, also referred to herein as a "secondary component" or "gel modifier," as defined below. This second component may facilitate gel formation and/or modify the physical properties of a polysaccharide gel including such properties as viscosity, polymer swelling, crosslinking, macromolecular assembly, and the like. Exemplary systems include a polysaccharide and a crosslinker or a polysaccharide and a secondary hydrophilic polymer. An "aqueous polysaccharide-based gellant system" refers to such a gel system formed in predominantly water as the based solvent carrier.

As used herein, "polysaccharide" refers to any polymer structure having one or more sugar monosaccharides as a base unit. Such monosaccharides include hexose sugars or pentose sugars. Example hexose monosaccharide units include, without limitation, glucose, galactose, glucosamine, N-acetyl glucosamine, allose, altrose, mannose, gulose, idose, and talose. Example pentose monosaccharide units include, without limitation, ribose, arabinose, eibose, lyxose, and xylose. Polysaccharides may be crosslinked, branched, linear, or combinations thereof. The exact selection of polysaccharide moiety is generally guided by its viscosity behavior and more specifically its ability to form gels when placed in aqueous media. Examples are described throughout the present disclosure and include gums such as guar gum, celluloses, and other crosslinkable polymer structures.

As used herein, "crosslinker" refers to any chemical moiety capable of forming interconnecting linkages between polysaccharide molecules. These may be metal ions or other chemical moieties capable of forming extended hydrogen bonding networks. For example, alginate crosslinkers may employ any number of multivalent metal ions such as calcium, magnesium= or the like. A crosslinker is designed to create a larger supermolecular structure. Crosslinkers will generally serve as gel modifiers, as described below.

As used herein, terms such as "borate," "titanate," "silicate," and "aluminate," refer to the so called oxygen-containing "-ate" structures of corresponding atom. Such compounds are characterized by their high oxygen content and the atom-oxygen-ate moiety being anionic (i.e., negatively charged).

As used herein, "gel modifier" is a compound that modulates the supramolecular architecture (e.g. crosslinking) of the polysaccharide that forms the basis of the gel structure. While some polysaccharides described herein may be capable of performing the role of a primary polysaccharide of a gellant system and the role of a gel modifier, the gellant systems herein are two component systems such that the polysaccharide and the gel modifier are not the same molecule. Thus, a polysaccharide that gels in water with no further additives is a gellant system but does not contain a gel modifier. Gel modifiers may be integral to actual gel formation such that no gel forms with particular polysaccharides in the absence of the gel modifier. In embodiments, gel modifiers provide a crosslinking function. In embodiments, gel modifiers may operate on existing polysaccharide gels to change the supramolecular organization. In embodiments, gel modifiers may cause the gel to be stiffer or more relaxed. In embodiments, some gel modifiers may play a role in modulating gel viscosity and/or mechanical strength. In embodiments, gel modifiers alter the nature of the gel structure. Gel modifiers may include crosslinkers, such as metal ions and/or surfactants, water-soluble polymers, secondary polysaccharides, organic acids, organic bases, aldehydes, amines, radical sources, such as methacrylated alginates photopolymerized with photoinitiators, 2-hydroxy-1-[4-(2-hydroxyethoxy) phenyl]-2-methyl-1-propanone (Irgacure 2959) and combinations thereof.

As used herein, "nicotine" refers to both its free base and salt form. The salt form is typically generated by adding an organic acid to nicotine, although inorganic acids such as hydrochloric acid, hydrobromic acid, sulfuric acid, phosphoric acid, may also be used to form salts. The term "organic acid" encompasses any organic molecule possessing at least one acidic functional group, but most commonly the carboxylic acid functional group. In embodiments, suitable organic acids comprise carboxylic acids. In some embodiments, organic carboxylic acids disclosed herein are monocarboxylic acids, dicarboxylic acids (organic acid containing two carboxylic acid groups), and carboxylic acids containing an aromatic group such as benzoic acids, hydroxycarboxylic acids, heterocyclic carboxylic acids, terpenoid acids, and sugar acids; such as the pectic acids, amino acids, cycloaliphatic acids, aliphatic carboxylic acids, keto carboxylic acids, and the like. In some embodiments, suitable acids comprise formic acid, acetic acid, propionic acid, butyric acid, valeric acid, caproic acid, caprylic acid, capric acid, citric acid, lauric acid, myristic acid, palmitic acid, stearic acid, oleic acid, linoleic acid, linolenic acid, phenylacetic acid, benzoic acid, pyruvic acid, levulinic acid, tartaric acid, lactic acid, malonic acid, succinic acid, fumaric acid, gluconic acid, saccharic acid, salicyclic acid, sorbic acid, malonic acid, malic acid, or a combination thereof. In some embodiments, a suitable acid comprises one or more of benzoic acid, pyruvic acid, salicylic acid, levulinic acid, malic acid, succinic acid, and citric acid. In some embodiments, a suitable acid comprises one or more of benzoic acid, pyruvic acid, and salicylic acid. In some embodiments, a suitable acid comprises benzoic acid.

As used herein, nicotine is provided as either a component of an extract of tobacco material or resides in the tobacco particulate material itself. Accordingly, reference to nicotine will be understood to be referring to nicotine in a tobacco material extract or particulate tobacco materials, but not purified nicotine.

As used herein, "tobacco material" refers to both particulate tobacco leaf material, as well as extracts of tobacco leaf. Tobacco material may be pure or a blend of tobaccos. When used in particulate form, the average particle size may be in a range from about 50 microns to about 1000 microns. In embodiments, the average particle size may be in a range from about 100 microns to 250 microns. The tobacco material used may be processed to remove HPHCs or to include desirable volatiles. Further, the tobacco material may include extractants of pure or tobacco blends.

As used herein, "humectant" refers to any agent that provides for retention of moisture. In particular, humectants may include polar organic co-solvents that serves as water carriers. Examples include polyoxygenated organics such as glycol, propylene glycol, glycerin, and the like.

As used herein, "flavoring agent" refers to a flavorant that imparts a flavor to the compositions herein when heated as part of delivering nicotine to a user. Examples of salts which can provide flavor and aroma to the mainstream aerosol at certain levels include nicotine acetate, nicotine oxalate, nicotine malate, nicotine isovalerate, nicotine lactate, nicotine citrate, nicotine phenylacetate and nicotine myristate. Flavors include both natural and synthetic. Some of the examples include Mint, Virginia tobacco, menthol, berry, mango, crème, vanilla and the like.

As used herein, "cellulose matrix" refers to the polymeric chemical moiety that serves as the organizing structure of a gel in aqueous solution. The term "matrix" more generally refers to any of the organizing polysaccharide-based structures that serve to provide supramolecular organized gel structures.

As used herein, "water-soluble polymer" refers to hydrophilic polymers that solubilize in water. Water-soluble polymers include polyethers. Examples of water-soluble polymers include polyethylene glycol (PEG), a block copolymer of PEG and polypropylene glycol (PPG), and combinations thereof, and polyvinylpyrrolidone. The water-soluble polymer may have a number average molecular weight ($M_n$) from about 5,000 daltons to about 30,000 daltons. In other embodiments, the water-soluble polymer has a number average molecular weight ($M_n$) from about 10,000 daltons to about 20,000 daltons. As used herein, the water-soluble polymers are specifically selected for their ability to encapsulate other polysaccharide structures which may have lower solubility in water. As such, the water-soluble polymer may serve as a solubilizing aid for various polysaccharide based gel structures.

The compositions disclosed herein may take numerous forms. One such form is "macroscopic beads." As used herein, "macroscopic beads" include any particles of a sufficient size to be visible to the naked eye without magnification. More generally, the compositions may comprise any particle type. "Particle" refers to generally spherical particulate forms, though they need not be perfectly spherical and can include oval particles and other irregular shapes. Whether as macroscopic beads or particles, the compositions may comprise a homogeneous gel structure throughout the particle or may be in the form of a "gel shell." A gel shell refers to a thin encapsulating gel layer that may have a non-gel fluid internal structure, such as an aqueous solution. Other forms of the compositions herein may include "films." "Films" refer to thin layered structures of the composition, which may be formed on a substrate which serves as a support for holding the composition in its film form.

As used herein, "hydrated ionic clay" refers to ionic clays that possess water molecules of hydration. An "ionic clay" includes any synthetic layered material carrying either a negative charge or a positive charge. The hydrated ionic clay can be an anionic layered alkaline clay. The hydrated ionic clay can comprise silicates. The hydrated ionic clay can comprise alkali and/or alkaline earth metal silicates. The hydrated ionic clay can be a magnesium silicate clay. The hydrated ionic clay can be a sodium magnesium silicate clay. The hydrated ionic clay can be a synthetic tri-octahedral clay mineral. The hydrated ionic clay comprises aluminates, titanates and/or zirconates. The hydrated ionic clay can be an aluminate, such as layered double hydroxide carrying net positive charge. The hydrated ionic clay can be a synthetic phyllosilicate. The synthetic phyllosilicate can be a lithium magnesium sodium orthosilicate. The hydrated ionic clay can comprise phosphates. The synthetic phyllosilicate can be an inorganic composition comprising hydrogen, lithium, magnesium, sodium, oxygen, and silicon. In embodiments, the hydrated ionic clay is a Laponite clay. "Laponite clay" refers to a synthetic smectic clay that forms a clear, thixotropic gel when dispersed in water. It has the general formula: $H_{12}Li_2Mg_{16}Na_2O_{72}Si_{24}$. Laponite is available in different grades. In embodiments, a hydrated ionic clay may be a "gel forming grade", e.g. a grade of Laponite that forms gels when placed in water. In embodiments, the hydrated ionic clay is a sol forming grade, e.g. a sol forming grade of Laponite.

In embodiments, provided herein are compositions comprising an aqueous polysaccharide-based gellant system comprising a polysaccharide and a gel modifier along with a tobacco material. Polysaccharide-based gellant systems are designed as carriers for tobacco materials, which may be integrated into a device to deliver nicotine to a user, as described herein below. The selection of a particular polysaccharide may be guided by both performance characteristics of the gel as well as safety and stability issues. In general, polysaccharide-based systems benefit from being classified as "generally regarded as safe" (GRAS) ingredients. Polysaccharides of a wide variety of structures give access to gels of differing strength (measurable as a viscosity, for example) and form, such as beads, paste-like materials, and bulk solid jelly-like masses. In embodiments, polysaccharide-based gels may be tuned by controlling the molecular weight of the polysaccharide. In embodiments, polysaccharide-based gels may be tuned by controlling temperature of gel formation. In embodiments, polysaccharide-based gels may be tuned by controlling pH. In embodiments, polysaccharide-based gels may be tuned by controlling any combination of aforementioned factors. In embodiments, gel systems may be thermoreversible. A thermoreversible gel may be a gel at ambient temperatures but may liquefy upon heating and return to gel form on cooling. In other embodiments, the polysaccharide-based gel systems are specifically selected to not be thermoreversible.

One or more features of polysaccharides selected for the gellant systems disclosed herein may affect interactions with an inhalable bioactive agent. In embodiments, the polysaccharide may have a hydrophobic core to accommodate an inhalable bioactive agent in aqueous media. In embodiments, the presence of a charged group in the polysaccharide backbone can interact with the inhalable bioactive agent or its salt. In embodiments, the degree of branching in the polysaccharide polymer can be modified to interact with an inhalable bioactive agent. In embodiments, gelation temperatures may affect interaction between the gellant system and an inhalable bioactive agent. In embodiments, the use of crosslinkers can impact gel formation or modify gel viscosity impacting interaction between the gellant system and an inhalable bioactive agent. In embodiments, the polysaccharide in the aqueous polysaccharide-based gellant system provided herein is hydrophobic. In embodiments, the polysaccharide forms a hydrophobic core within the aqueous polysaccharide-based gellant system. In embodiments, the polysaccharide is cellulose. In embodiments, the polysaccharide is amylose.

In embodiments, the polysaccharide of the gellant system is selected from the group consisting of an alginic acid, a cellulose, a guar (galactomannan), a xanthan gum, an agar, a gellan, an amylose, a welan gum, a rhamsan, a carrageenan, a chitosan, a scleroglucan, a diutan gum, a pectin, a starch, derivatives thereof, and combinations thereof. In embodiments, the polysaccharide of the gellant system is an alginic acid. In embodiments, the polysaccharide of the gellant system is a cellulose. In embodiments, the polysaccharide of the gellant system is a guar (galactomannan). In embodiments, the polysaccharide of the gellant system is a xanthan gum. In embodiments, the polysaccharide of the gellant system is an agar. In embodiments, the polysaccharide of the gellant system is a gellan. In embodiments, the polysaccharide of the gellant system is an amylose. In embodiments, the polysaccharide of the gellant system is a welan. In embodiments, the polysaccharide of the gellant system is rhamsan. In embodiments, the polysaccharide of the gellant system is a carrageenan. In embodiments, the polysaccharide of the gellant system is a chitosan. In embodiments, the polysaccharide of the gellant system is a scleroglucan. In embodiments, the polysaccharide of the gellant system is a diutan gum. In embodiments, the polysaccharide of the gellant system is a pectin. In embodiments, the polysaccharide of the gellant system is a starch. In embodiments, the polysaccharide of the gellant system is a derivative of any of the polysaccharides disclosed herein. In embodiments, the polysaccharide of the gellant system is a combination of any of the polysaccharides disclosed herein.

In embodiments, alginic acids may be provided in salt form prior to gelation. In embodiments, alginic acid precursor for gel formation is a salt form selected from the group consisting of sodium alginate, ammonium alginate, and potassium alginate. Alginic acids have the general structure of formula (I):

(I)

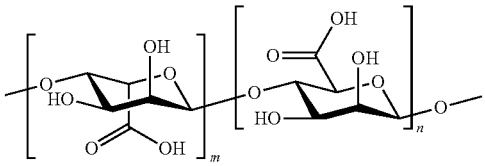

having repeating blocks of beta-D-mannuronate (M) and alpha-L-guluronate (G) and where m and n define a ratio of M to G of 1.6:1. In embodiments, m and n have a combined effect of providing a number resulting in a polymer with a weight average molecular weights ranging from about 1 Kdaltons to about 600 Kdaltons. In embodiments, m and n have a combined effect of providing a number resulting in a polymer with a weight average molecular weights ranging from about 5 Kdaltons to about 100 Kdaltons. In embodiments, m and n have a combined effect of providing a number resulting in a polymer with a weight average molecular weights ranging from about 6 Kdaltons to about 16 Kdaltons. In embodiments, alginate structures display three block types, sections of homo M, as in MMMMMM, blocks of homo G, as in GGGGGG, and blocks of alternating G and M as in GMGMGMGM. The total number of residues (m+n) can vary from about 50 residues to about 100,000 residues. In embodiments, a number average molecular weight may be from about 1 Kdaltons to about 50 Kdaltons. In embodiments, a number average molecular weight may be from about 1 Kdaltons to about 20 Kdaltons. In embodiments, a number average molecular weight may be from about 10 Kdaltons to about 50 Kdaltons. In embodiments, where the gellant system includes alginic acid, the crosslinker can be a metal crosslinker. In embodiments, the metal crosslinker is a divalent metal ion. In embodiments, the metal crosslinker is a trivalent metal ion. Alginic acid can also be co-crosslinked with other polysaccharides, such as chitosan.

In embodiments, the polysaccharide-based gellant systems herein is a cellulose. In embodiments, the polysaccharide-based gellant systems herein is a precursor of a cellulose. In embodiments, the polysaccharide-based gellant systems herein is a cellulose derivative. In embodiments, the cellulose is selected from cellulose, methyl cellulose, ethyl cellulose, ethyl methyl cellulose, hydroxyethyl cellulose, hydroxypropyl cellulose, hydroxyethyl methyl cellulose, hydroxypropyl methyl cellulose, ethyl hydroxyl ethyl cellulose, carboxymethyl cellulose, carboxymethylhydroxyethyl cellulose, cellulose sulfate, cellulose acetate, and combinations thereof. In embodiments, the polysaccharide-based gellant systems herein is methyl cellulose. In embodiments, the polysaccharide-based gellant systems herein is ethyl cellulose. In embodiments, the polysaccharide-based gellant systems herein is ethyl methyl cellulose. In embodiments, the polysaccharide-based gellant systems herein is hydroxyethyl cellulose. In embodiments, the polysaccharide-based gellant systems herein is hydroxyethyl cellulose. In embodiments, the polysaccharide-based gellant systems herein is hydroxypropyl cellulose. In embodiments, the polysaccharide-based gellant systems herein is hydroxyethyl methyl cellulose. In embodiments, the polysaccharide-based gellant systems herein is hydroxypropyl methyl cellulose. In embodiments, the polysaccharide-based gellant systems herein is ethyl hydroxyl ethyl cellulose. In embodiments, the polysaccharide-based gellant systems herein is carboxymethyl cellulose. In embodiments, the polysaccharide-based gellant systems herein is carboxymethylhydroxyethyl cellulose. In embodiments, the polysaccharide-based gellant systems herein is cellulose sulfate. In embodiments, the polysaccharide-based gellant systems herein is cellulose acetate. In embodiments, the polysaccharide-based gellant systems herein is a combination of any cellulose or derivative of cellulose disclosed herein.

Cellulose itself has the structure of formula (II):

(II)

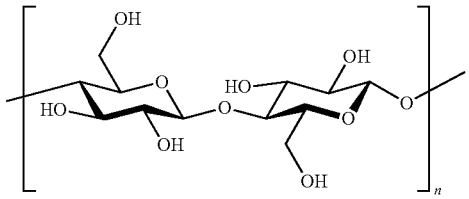

having a linear array of beta-D-glucose units where n may vary from about 10 to about 500. In embodiments, n can vary from about 20 to about 100. In embodiments, cellulose may have a number average molecular weight from 1 Kdaltons to about 20 Kdaltons. In embodiments, cellulose may have a number average molecular weight from 2 Kdaltons to about 15 Kdaltons. In embodiments, cellulose may have a number average molecular weights in a range from about 5.5 Kdaltons to about 11 Kdaltons. In embodiments, gellant systems employing the parent cellulose may be formed via a cellulose precursor such as cellulose acetate. In embodiments, the acetate groups can be removed by solvolysis. In embodiments, functionalized celluloses may be used to alter the polarity of the gellant system and/or to tune the viscosity of the resultant gel. In embodiments, charged cellulose derivatives carrying organic functional acids such as carboxymethyl cellulose have tunable viscosity via pH adjustment with acids or bases. In embodiments, charged cellulose derivatives may immobilize an inhalable bioactive agent. In embodiments, charged cellulose derivatives form a salt bridge with an inhalable bioactive agent. In embodiments, cellulose-based gels may be formed in the presence of water-soluble polymers as described herein further below.

In embodiments, the polysaccharide based gellant systems may employ a guar. In some such embodiments, the guar is selected from natural guar, hydroxypropylguar (HPG), sulfonated guar, sulfonated hydroxypropylguar, carboxymethyl hydroxypropyl guar (CMHPG), carboxymethylguar. In embodiments, the guar is a natural guar. In embodiments, the guar is hydroxypropylguar (HPG). In embodiments, the guar is sulfonated guar. In embodiments, the guar is sulfonated hydroxypropylguar. In embodiments, the guar is carboxymethyl hydroxypropyl guar (CMHPG). In embodiments, the guar is carboxymethyl guar. Guars have a core structure based on Formula (III):

(III)

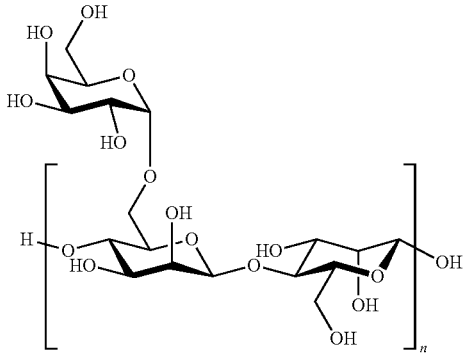

having pendant galactose unit appearing on a backbone of beta-linked mannose units where n provides molecular weights a number average molecular weight of about 100 to about 500 Kdaltons. In embodiments, n provides molecular weights a number average molecular weight of about 125 to about 300 Kdaltons. In embodiments, a weight average molecular weight may be in a range from about 500 Kdaltons to about 2,500 Kdaltons. In embodiments, a weight average molecular weight may be in a range from about 700 Kdaltons to about 1,500 Kdaltons. In embodiments, a number average molecular weight is ($M_n$) about 240 Kdaltons and a weight average molecular weight ($M_w$) of 950 Kdaltons. In embodiments, guars can be gelled in the presence of crosslinkers such as calcium ion, borates, titanates, and the like. In embodiments, guars bearing charged groups may assist in immobilizing the inhalable bioactive agent. In embodiments, the charged guar is sulfonated guar. In embodiments, functionalized guars may be used to tune the hydrophobicity/hydrophilicity of the gel system to accommodate the particular inhalable bioactive agent.

In embodiments, the polysaccharide-based gellant system may comprise a xanthan gum. Xanthan gums are obtained from the species of bacteria used, *Xanthomonas campestris*. Xanthan gums have a basic core structure of formula (IV):

(IV)

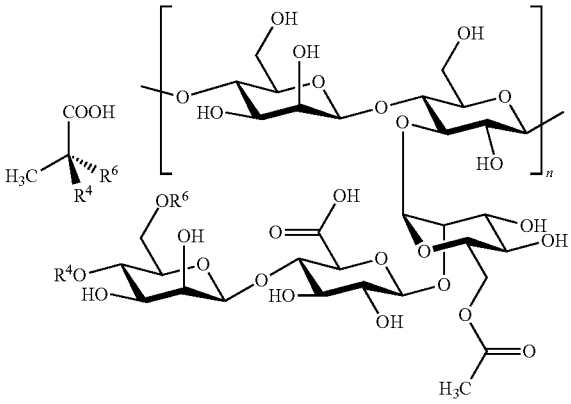

In embodiments, modified xanthan gums can be used in forming hydrogels. In embodiments, the native form xanthan gums can be used as gel modifiers including as viscosity modifying agents as disclosed herein. The value for n in formula IV, based on a 2 Kdaltons MW of the formula (IV) monomer unit, provides a weight average molecular weight in a range from about 300 Kdaltons to about 8 megadaltons, in embodiments. In embodiments, the weight average molecular weight is in a range from about 500 Kdaltons to about 1 megadalton. In embodiments, the weight average molecular weight is in a range from about 700 Kdaltons to about 1 megadalton.

In embodiments, the polysaccharide-based gellant system may comprises an agar. Agar itself is typically a mixture of agarose of formula (V) and agaropectin:

(V)

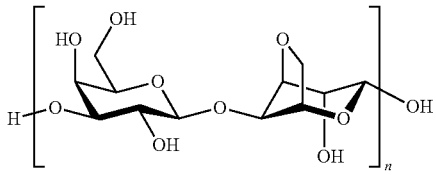

The agarose backbone is a disaccharide made up of D-galactose and 3,6-anhydro-L-galactopyranose. In embodiments, n has a value such that a molecular weight of agarose is about 50 to about 400 Kdaltons. In embodiments, n has a value such that a molecular weight of agarose is about 75 to about 200 Kdaltons. In embodiments, n has a value such that a molecular weight of agarose is about 120 Kdaltons. Agaropectin is a heterogeneous mixture of smaller oligosaccharides which performs the function of a gel modifier as defined herein. In embodiments, agaropectin may have an ester sulfate content conferring a charge which may facilitate interaction with the inhalable bioactive agent.

In embodiments, the polysaccharide-based gellant system may comprise a gellan. Gellan gum water-soluble anionic polysaccharide produced by the bacterium *Sphingomonas elodea* of structural formula (VI):

(VI)

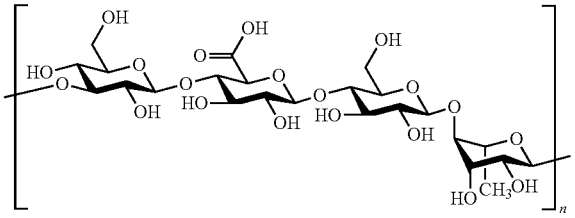

where n provides weight average molecular weights in a range from about 0.5 megadaltons to about 3 megadaltons. In embodiments, reduced weight gellants have molecular weights from about 0.5 megadaltons to about 1.5 megadaltons.

In embodiments, the polysaccharide-based gellant system may comprise an amylose. Amylose is comprised of alpha linked D glucose units as indicated in formula (VII) below:

(VII)

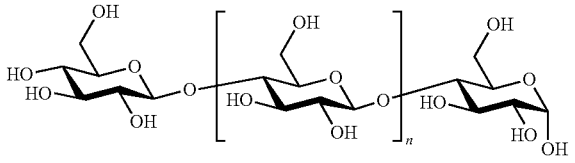

In embodiments, n is an integer from about 100 to about 1000. In embodiments, n is an integer from about 200 to about 700. In embodiments, n is an integer from about 300 to about 600. In embodiments, amylose can be provided in conjunction with starch, wherein starch provides the primary polysaccharide of the gellant system and amylose serves as the gel modifier. For example, amylose may be used to modulate gel viscosity of starch-based gellant systems. In other embodiments, amylose is the primary polysaccharide of the gellant-based system. In embodiments, amylose may be particularly combined with xanthan gum, or alginate in other embodiments, or carrageenan in yet other embodiments.

In embodiments, the polysaccharide-based gellant system may comprise a welan gum. Welan gum is produced by fermentation of sugar by bacteria of the genus *Alcaligenes*. molecule consists of repeating tetrasaccharide units with single branches of L-mannose or L-rhamnose and is shown below as formula (VIII):

(VIII)

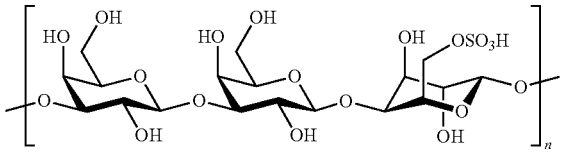

where n has a value such that a weight average molecular weight is in a range from about 0.25 megadaltons to about 3 megadaltons. In embodiments, n has a value such that a weight average molecular weight is in a range from about 0.5 megadaltons to about 2 megadaltons. In embodiments, n has a value such that a weight average molecular weight is about 1 megadalton.

In embodiments, the polysaccharide-based gellant system may comprise a rhamsan. Rhamsan gums may be obtained in acetylated or deacetylated form. Deacetylated rhamsan forms gel materials when crosslinked with divalent metal ions such as calcium ion. Deacetylated rhamsan gum can be particularly thermally stable in water and has a structure shown in formula (IX):

(IX)

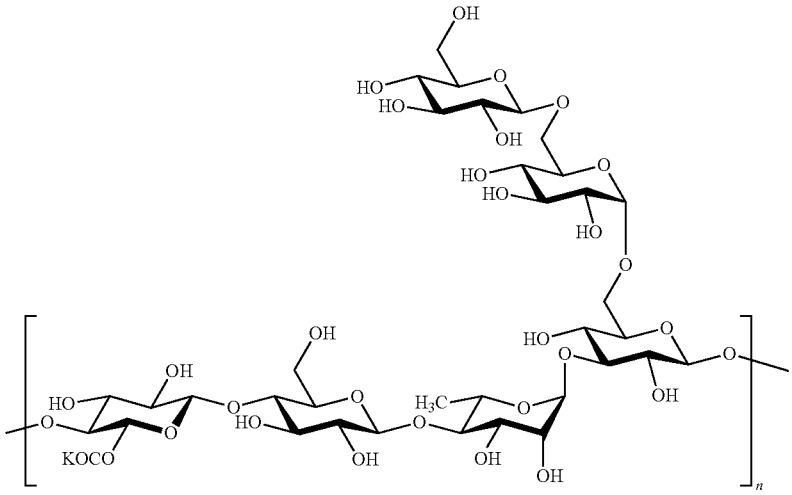

where n provides molecular weights in a range similar to that of diutan discussed herein further below.

In embodiments, the polysaccharide-based gellant system may include a carrageenan. Carrageenans polysaccharides come in three common forms naturally kappa, iota, and lambda. In embodiments, the structural variation provides access to gels with tunable properties. In embodiments, the carrageenan is kappa form. In embodiments, the carrageenan is iota form. In embodiments, the carrageenan is lambda form. Carrageenans include repeating galactose units and 3,6 anhydrogalactose and can be both sulfated and nonsulfated. The units are joined by alternating alpha-1,3 and beta-1,4 glycosidic linkages. The structures of numerous carrageenan cores are shown below. In embodiments, the carrageenan may be a lambda carrageenan. In embodiments, lambda carrageen is used in an aqueous system. In embodiments, the carrageenan is a sulfated form.

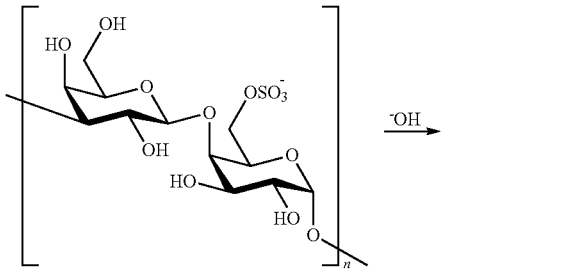

γ-carrageenan

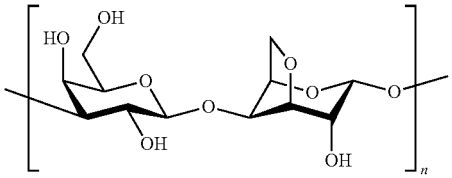

β-carrageenan

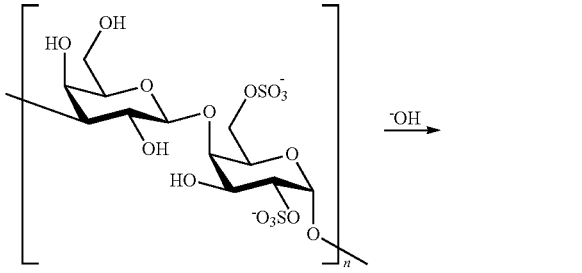

δ-carrageenan

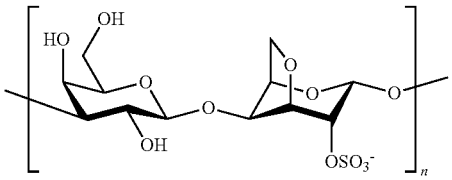

α-carrageenan

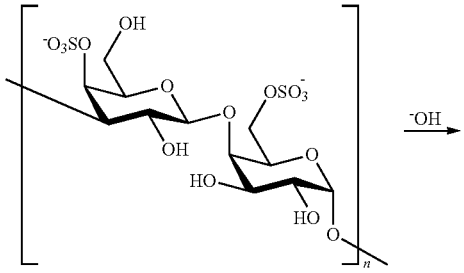

μ-carrageenan

-continued

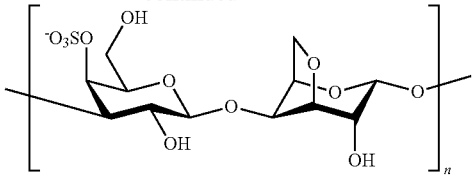

κ-carrageenan

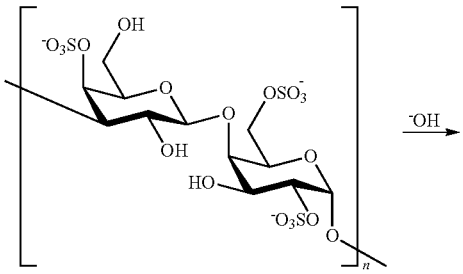

ν-carrageenan

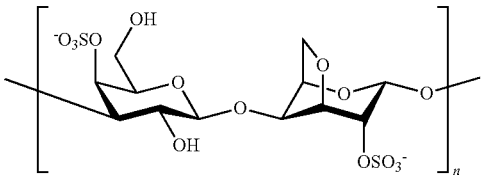

ι-carrageenan

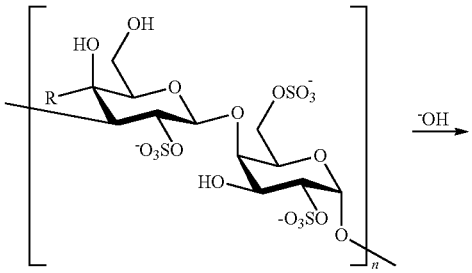

λ-carrageenan

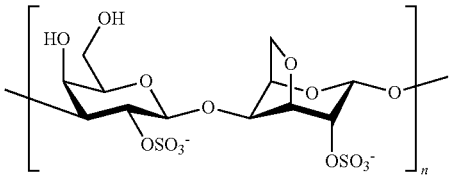

θ-carrageenan where values of n provide weight average molecular weights between about 100 Kdaltons to about 5,000 Kdaltons. In embodiments, n provides weight average molecular weights between about 300 Kdaltons to about 2,000 Kdaltons. In embodiments, n provides weight average molecular weights between about 400 Kdaltons to about 1,000 Kdaltons.

In embodiments, the polysaccharide-based gellant system may comprise a chitosan. Chitosan is a readily available material derived from the shell material of shrimp and other crustaceans. Chitosan has a structure of formula (X):

(X)

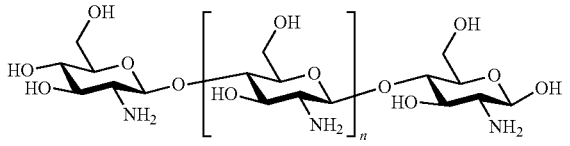

where values of n provide weight average molecular weights between about 10 Kdaltons to about 4,000 Kdaltons. In embodiments, n provides weight average molecular weights between about 50 Kdaltons to about 2,000 Kdaltons. In embodiments, n provides weight average molecular weights between about 100 Kdaltons to about 800 Kdaltons.

In embodiments, chitosan is co-crosslinked with alginate.

In embodiments, the polysaccharide-based gellant system may comprise a scleroglucan. Scleroglucans have a general structure as shown in formula (XI):

(XI)

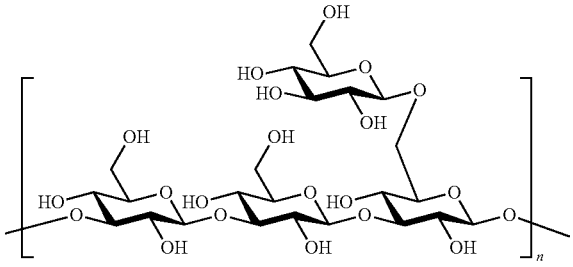

where values of n provide weight average molecular weights in a range from about 0.5 megadaltons to about 4 megadaltons. In embodiments, n provides weight average molecular weights from about 1 megadaltons to about 3 megadaltons. In embodiments, n provides weight average molecular weights of about 2 megadaltons.

In embodiments, scleroglucans form gels in the presence of sodium tetraborate (borax). In embodiments, hydrogels are formed form partially oxidized scleroglucans, In embodiments, the gel character is tuned by the degree of oxidation.

In embodiments, the polysaccharide-based gellant system may include a diutan gum. Diutan is a complex polysaccharide structures with a backbone made up of d-glucose, d-glucuronic acid, d-glucose, and 1-rhamnose, and a side chain of two 1-rhamnose residues. In embodiments, diutans have a weight average molecular weight from about 1 megadaltons to about 10 megadaltons. In embodiments, diutans have a weight average molecular weight of about 5 megadaltons. In embodiments, diutans are a gel modifier. In embodiments, diutans are used with other polysaccharides that are amenable to calcium ion crosslinking.

In embodiments, the polysaccharide-based gellant system may include a pectin. Pectins are polysaccharides rich in galacturonic acid and are found commonly in fruits. In nature, the galacturonic acids may be present with a variable degree of methylation (methyl ester). In embodiments, the pectin is a so called "low methoxy" pectin, i.e., a low degree of methyl ester, called LM-pectin. LM-pectin readily forms a gel system in the presence of calcium ion as a crosslinker.

In embodiments, the primary polysaccharide of a gellant system may be present in an amount from about 1 to about 50% w/w of the gel composition. In embodiments, the primary polysaccharide may be present at about 1% w/w of the gel composition, or about 2%, or about 3%, or about 5%, or about 10%, or about 15%, or about 20%, or about 25%, or about 30%, or about 35%, or about 40%, or about 45%, or about 50% w/w, including any value in between and fractions thereof. In embodiments, the primary polysaccharide of a gellant system may be present in an amount from about 1% w/w/ to 10% w/w of the gel composition, or about 10% w/w to about 20% w/w of the gel composition, or about 20% w/w to about 30% w/w of the gel composition, or 30% w/w to about 40% of the gel composition, or about 40% w/w to about 50% w/w of the gel composition, including any sub-range in between and fractions thereof.

In embodiments, the gellant systems comprise a gel modifier. In some such embodiments, the gel modifier comprises a crosslinker. Polyhydric systems (containing many hydroxyl groups) such as polysaccharides are frequently susceptible to crosslinking in the presence of metal ions. In some such embodiments, the crosslinker may comprise a divalent or trivalent metal cation. Among divalent metal cations, the crosslinker may comprise any of the alkaline earth metals. Exemplary crosslinkers may comprise a borate, a titanate, calcium ion, aluminum ion, copper ion, zinc ion, zirconium ion, magnesium ion, oxides of any of the foregoing metals and combinations thereof.

Other crosslinkers or viscosity managing gel modifiers in polysaccharide-based gellant systems include surfactants. When present, the surfactant may include one or more of an anionic surfactants, a cationic surfactant, a zwitterionic and/or non-ionic surfactant, and combinations thereof. In embodiments, the polysaccharide-based gellant includes an anionic surfactant. In embodiments, the polysaccharide-based gellant includes a cationic surfactant. In embodiments, the polysaccharide-based gellant includes zwitterionic surfactant. In embodiments, the polysaccharide-based gellant includes non-ionic surfactant.

In embodiments, anionic surfactants which may be utilized include sulfates and/or sulfonates. In embodiments, the anionic surfactant is sodium dodecylsulfate (SDS). In embodiments, the anionic surfactant is sodium dodecylbenzene sulfonate. In embodiments, the anionic surfactant is sodium dodecylnaphthalene sulfate. In embodiments, the anionic surfactant is dialkyl benzenealkyl sulfates and/or sulfonates. In embodiments, the anionic surfactant is an acid. In embodiments, the acid is abitic acid (Aldrich). In embodiments, the acid is NEOGEN® (Daiichi Kogyo Seiyaku). In embodiments, the anionic surfactant is DOWFAX™ 2A1, an alkyldiphenyloxide disulfonate (The Dow Chemical Company). In embodiments, the anionic surfactant is TAYCA POWDER BN2060 from (Tayca Corporation), which are branched sodium dodecylbenzene sulfonates.

In embodiments, the cationic surfactant is alkylbenzyl dimethyl ammonium chloride. In embodiments, the cationic surfactant is dialkyl benzenealkyl ammonium chloride. In embodiments, the cationic surfactant is lauryl trimethyl ammonium chloride. In embodiments, the cationic surfactant is alkylbenzyl methyl ammonium chloride. In embodiments, the cationic surfactant is alkyl benzyl dimethyl ammonium bromide. In embodiments, the cationic surfactant is benzalkonium chloride. In embodiments, the cationic surfactant is cetyl pyridinium bromide. In embodiments, the cationic surfactant is a $C_{12}$, $C_{15}$, and/or $C_{17}$ trimethyl ammonium bromide. In embodiments, the cationic surfactant is a halide salt of quaternized polyoxyethylalkylamines. In embodiments, the cationic surfactant is dodecylbenzyl triethyl ammonium chloride. In embodiments, the cationic surfactant is MIRAPOL™. In embodiments, the cationic surfactant is ALKAQUAT™ (Alkaril Chemical Company). In embodiments, the cationic surfactant is SANIZOL™ (benzalkonium chloride, Kao Chemicals).

In embodiments, the zwitterionic surfactant is a betaine.

In embodiments, the non-ionic surfactants is polyacrylic acid. In embodiments, the non-ionic surfactants is methalose. In embodiments, the non-ionic surfactants is methyl cellulose. In embodiments, the non-ionic surfactants is ethyl cellulose. In embodiments, the non-ionic surfactants is propyl cellulose. In embodiments, the non-ionic surfactants is hydroxy ethyl cellulose. In embodiments, the non-ionic surfactants is carboxy methyl cellulose. In embodiments, the non-ionic surfactants is polyoxyethylene cetyl ether. In embodiments, the non-ionic surfactants is polyoxyethylene lauryl ether. In embodiments, the non-ionic surfactants is polyoxyethylene octyl ether. In embodiments, the non-ionic surfactants is polyoxyethylene octylphenyl ether. In embodiments, the non-ionic surfactants is polyoxyethylene oleyl ether. In embodiments, the non-ionic surfactants is polyoxyethylene sorbitan monolaurate. In embodiments, the non-ionic surfactants is polyoxyethylene stearyl ether. In embodiments, the non-ionic surfactants is polyoxyethylene nonylphenyl ether. In embodiments, the non-ionic surfactants is dialkylphenoxy poly(ethyleneoxy) ethanol. Note, that among these non-ionic surfactants that act as gel modifiers include examples of functionalized celluloses. Their use as a gel modifier for their surfactant character would be in conjunction with a primary polysaccharide for the purpose of forming the gellant systems disclosed herein.

In embodiments, the gel modifier includes a water-soluble polymer. In embodiments, the water-soluble polymer displays surfactant character. In embodiments, the water-soluble polymer is selected from a polyether, a polyvinylpyrrolidone, a polyvinyl alcohol, a polyacrylic acid, a polyacrylamide, a polyoxazoline, a polyphosphate, and an albumin. Exemplary water-soluble polymers include polyethylene glycols (PEGs), polaxamers such as PLURONIC™ F-127 (BASF), and water-soluble polysaccharides or their derivatives in classes such as xanthan gums, pectins, chitosans, dextrans, carrageenans, guar gums, and the like. In embodiments, the gel modifier is a polyether. In embodiments, the gel modifier is a polyvinylpyrrolidone. In embodiments, the gel modifier is a polyvinyl alcohol. In embodiments, the gel modifier is a polyacrylic acid. In embodiments, the gel modifier is a polyacrylamide. In embodiments, the gel modifier is a polyoxazoline. In embodiments, the gel modifier is a polyphosphate. In embodiments, the gel modifier is an albumin. In embodiments, the water-soluble polymer is a polyethylene glycol (PEG). In embodiments, the water-soluble polymer is a polaxamer. In embodiments, the polaxomer is PLURONIC™ F-127 (BASF). In embodiments, the water-soluble polymer is a polysaccharide. In embodiments, the water-soluble polymer is a xanthan gum. In embodiments, the water-soluble polymer is a pectin. In embodiments, the water-soluble polymer is a chitosan. In embodiments, the water-soluble polymer is a dextran. In embodiments, the water-soluble polymer is a carrageenan. In embodiments, the water-soluble polymer is a guar gum.

In embodiments, the water-soluble polymer is present in an amount from about 1 to about 50% w/w of the gel composition. In embodiments, the water-soluble polymer may be present at about 1% w/w of the gel composition, or about 2%, or about 3%, or about 5%, or about 10%, or about 15%, or about 20%, or about 25%, or about 30%, or about 35%, or about 40%, or about 45%, or about 50% w/w, including any value in between and fractions thereof. In embodiments, the water-soluble polymer of a gellant system may be present in an amount from about 1% w/w/ to 10% w/w of the gel composition, or about 10% w/w to about 20% w/w of the gel composition, or about 20% w/w to about 30% w/w of the gel composition, or 30% w/w to about 40% of the gel composition, or about 40% w/w to about 50% w/w of the gel composition, including any sub-range in between and fractions thereof.

In embodiments, in addition to the tobacco material, purified nicotine or salt thereof may be present in a non-zero amount up to about 50% w/w of the gel composition. In embodiments, purified nicotine or salt thereof may be present in an amount from about 1% w/w to about 5% w/w of the gel composition. In embodiments, purified nicotine is present from about 0.5% to about 1.5% w/w of the gel composition. Particular concentrations of purified nicotine can be tuned for delivery of precise amounts of nicotine to a user when the composition is heated in an electronic vapor device. In embodiments, the purified nicotine or salt thereof may be present at about 1% w/w of the gel composition, or about 2%, or about 3%, or about 5%, or about 10%, or about 15%, or about 20%, or about 25%, or about 30%, or about 35%, or about 40%, or about 45%, or about 50% w/w, including any value in between and fractions thereof. In embodiments, the purified nicotine or salt thereof may be present in an amount from about 1% w/w/ to 10% w/w of the gel composition, or about 10% w/w to about 20% w/w of the gel composition, or about 20% w/w to about 30% w/w of the gel composition, or 30% w/w to about 40% of the gel composition, or about 40% w/w to about 50% w/w of the gel composition, including any sub-range in between and fractions thereof.

Although the benefits of an aqueous-based polysaccharide system allow for water as the sole carrier for the tobacco material, nonetheless, compositions disclosed herein may further comprise a humectant. The humectant may serve as a delivery aid for delivering nicotine to a user when the tobacco materials are heated. In embodiments, the humectant comprises glycerin. In embodiments, the humectant comprises propylene glycol, vegetable glycerin, or combinations thereof. In embodiments, the propylene glycol, vegetable glycerin, or combinations thereof may comprise less than about 50% w/w of the composition, or may comprise less than 20% w/w of the composition, in other embodiments, or may comprise less than 10% w/w of the composition or may comprise less than 1% w/w of the composition, in further embodiments, or in still further embodiments, the humectant is free of one or more of propylene glycol and vegetable glycerin, though an alternative humectant is present. In embodiments, the humectant may comprise 1,3-propanediol. In embodiments, the humectant may comprise a medium chain triglyceride (MCT) oil. In embodiments, the humectant may comprise PEG 400. In embodiments, the humectant may comprise PEG 4000. In embodiments, the humectant may comprise Triacetin. In embodiments, the humectant is free of both propylene glycol and vegetable glycerin.

In embodiments, the compositions disclosed herein may include an organic acid. without being bound by theory, the organic acid may service the function of protonating nicotine from the tobacco material to deliver nicotine in a salt form, provide organoleptic properties, or both. Organic acids include, without limitation, benzoic acid, pyruvic acid, salicylic acid, levulinic acid, succinic acid, citric acid, malic acid, formic acid, acetic acid, propionic acid, butyric acid, valeric acid, caproic acid, caprylic acid, capric acid, lauric acid, myristic acid, palmitic acid, stearic acid, oleic acid, linoleic acid, linolenic acid, phenylacetic acid, tartaric acid, lactic acid, malonic acid, fumaric acid, finnaric acid, gluconic acid, saccharic acid, sorbic acid, and malonic acid.

In embodiments, compositions disclosed herein may further comprise a variety of other flavorants (including the aforementioned organic acids). In embodiments, flavorants may include natural extracts, such as menthol, mint, classic Virginia tobacco, cinnamon, clove, ginger, pepper, or other synthetic flavors based on esters and aldehydes. In embodiments, the flavorant may include nicotine salts, such as nicotine acetate, nicotine oxalate, nicotine malate, nicotine isovalerate, nicotine lactate, nicotine citrate, nicotine phenylacetate and nicotine myristate.

As will be apparent to the skilled artisan, gellant systems disclosed herein may take any of numerous forms. In embodiments, the gellant system is provided in the form of macroscopic beads. In some such embodiments, the macroscopic beads may be a shell encapsulating a solution of the tobacco material. In other embodiments, the macroscopic beads may be solid or semi-solid, and the nicotine or salt thereof is disposed within the gellant system matrix. In embodiments, the gellant system may be 3D-printed in any shape, including, for example, shapes that conform with a cavity of a cartridge in which the gellant may be contained.

In embodiments, the gellant system may be provided in the form of a film or strip. As such, the film or strip may be placed or formed directly on a heating element of an electronic vapor device. In other embodiments, the gellant system may be provided as a solid mass. In still further embodiments, the gellant system is provided as a plurality of particles of a size in a range from about 1 micron to about 1 mm. In embodiments, the gellant system reversibly forms a fluid liquid on heating and reforms the gellant system on cooling.

In embodiments, there are provided compositions comprising a cellulose matrix, a tobacco material, and a water-soluble polymer. The use of cellulose in an aqueous gellant system can be challenging due to it poor water solubility. Therefore, in embodiments, the cellulose matrix may be generated from a cellulose precursor or oligomers with low molecular weight. For example, a solution of cellulose acetate in an organic solvent may provide the precursor to cellulose. Cellulose may later be formed by acetate removal, which may be carried out solvolytically. In embodiments, the tobacco material may be added to the cellulose acetate solution. Separately, a water-soluble polymer may be added into water. The organic cellulosic solution may then be introduced into the aqueous polymer solution to induce gelation. The organic solvents may be removed by dialyzing or other means, such as evaporation under reduced pressure. The resulting material is a hydrogel of cellulose.

Accordingly, in embodiments, there are provided compositions made by a process comprising adding a tobacco material or a salt thereof to a precursor of a cellulose matrix in an organic solvent to form a mixture and adding to the mixture an aqueous solution of a water-soluble polymer. As an example of a preparation, a solution may be prepared with methanol and cellulose acetate in the presence of tobacco material. In embodiments, the tobacco material may be disposed in the core of the cellulose matrix. Separately, a water-soluble polymer is prepared. As an example, the water-soluble polymer may be PLURONIC™ F-127. The cellulose solution and water-soluble solutions are then combined. In embodiments, the particular structure formed here may be an encapsulated cellulose particle with the water-soluble polymer disposed about the outer surface of the cellulose acetate polymer. This structural feature has been supported by preliminary characterization. In embodiments, processes may further comprise removing the organic solvent by dialysis. Methanol water mixture that results from the combined solutions may be dialyzed against water as the bulk solvent. In embodiments, the dialysis bag may comprise a cellulose membrane with pore size ranging from about 500 Da molecular weight cutoff to about 2,000 Da molecular weight cutoff. Note, the solvents methanol, water, or both may serve to solvolyze the acetate groups on cellulose acetate to liberate the free cellulose structure. Alternatively, the solvent may be removed by evaporation, including evaporation under reduced pressure. In embodiments, the tobacco material remains disposed within the cellulose matrix, with the water-soluble polymer disposed about the particles of cellulose.

In embodiments, compositions made by the processes employ cellulose precursor which may be cellulose acetate, or any other organic soluble derivative that can be converted to cellulose. Such derivatives include conventional organic synthetic protecting groups for the hydroxyl group that confer solubility to cellulose. See Greene and Wuts, *Protecting Groups in Organic Chemistry,* $2^{nd}$ ed. John Wiley & Sons, NY (1991). In other embodiments, the cellulose precursor may be commercially available derivatives such as ethyl cellulose.

In embodiments, compositions made by the processes described above may employ any number of organic solvents. In embodiments, the organic solvent is selected from the group consisting of methanol, acetone, DMSO and combinations thereof.

Although embodiments described above employ a cellulose matrix (or precursor to generate a cellulose matrix), in other embodiments the cellulose may be a derivative selected from the group consisting of methyl cellulose, ethyl cellulose, ethyl methyl cellulose, hydroxyethyl cellulose, hydroxypropyl cellulose, hydroxyethyl methyl cellulose, hydroxypropyl methyl cellulose, ethyl hydroxyl ethyl cellulose, carboxymethyl cellulose, carboxymethylhydroxyethyl cellulose, cellulose sulfate, and combinations thereof.

In embodiments, composition that employ the product made by the above process may be particulate and have an effective diameter from about 1 micron to about 1 mm. In other embodiments, the particulate may have an effective diameter from about 1 micron to about 10 microns. The size may be controlled by the choice of a particular cellulose source (size, precursor type), solvent, and gel modifier selection.

In one or more of the preceding embodiments, the cellulose based gellant system may employ any water-soluble polymer. In embodiments, the water-soluble polymer is a polyether. In embodiments, the water-soluble polymer is selected from the group consisting of polyethylene glycol (PEG), a block copolymer of PEG and polypropylene glycol (PPG), and combinations thereof. In embodiments, the water-soluble polymer comprises a polyvinylpyrrolidone. The water-soluble polymer may have a number average molecular weight ($M_n$) from about 5,000 daltons to about 30,000 daltons. In other embodiments, the water-soluble polymer has a number average molecular weight (Mn) from about 10,000 daltons to about 20,000 daltons.

In embodiments, a ratio of the cellulose matrix to the water-soluble polymer is in a range from about 10:1 to about 1.5:1, and in embodiments, the ratio is in a range from about 5:1 to about 2:1. The cellulose matrix itself may be used in an amount from about 1 to about 10% w/w of the composition. In embodiments, cellulose may be present at about 1%, or about 2% or about 3%, or about 4%, or about 5%, or about 6%, or about 7%, or about 8%, or about 9%, or about 10% w/w of the composition, including any fractional value thereof.

In embodiments, a concentration of nicotine from the tobacco material (whether in particulate form or as extracted) in the cellulose-based gellant system may be a non-zero amount up to about 20 w/w %. In embodiments, nicotine or salt thereof may be present in the tobacco material in an amount from about 1% w/w to about 5% w/w of the gel composition. In embodiments, nicotine from the tobacco material may be present from about 0.5% to about 1.5% w/w of the gel composition. Particular concentrations of tobacco material can be tuned for delivery of precise amounts of nicotine to a user when the composition is heated in an electronic vapor device. In embodiments, the tobacco material may be present at about 1% w/w of the gel composition, or about 2%, or about 3%, or about 5%, or about 10%, or about 15%, or about 20%, or about 25%, or about 30%, or about 35%, or about 40%, or about 45%, or about 50% w/w, including any value in between and fractions thereof. In embodiments, the tobacco material may be present in an amount from about 1% w/w/ to 10% w/w of the gel composition, or about 10% w/w to about 20% w/w of the gel composition, or about 20% w/w to about 30% w/w of the gel composition, or 30% w/w to about 40% of the gel composition, or about 40% w/w to about 50% w/w of the gel composition, including any sub-range in between and fractions thereof. In embodiments, the tobacco material may be present in a non-zero amount up to about 90% of the composition.

Although cellulose provides access to a completely aqueous gellant system for delivering nicotine from the tobacco material when the composition is used, the composition may nevertheless further comprise a humectant. In one or more of the preceding embodiments, the humectant comprises propylene glycol, vegetable glycerin, or combinations thereof. In one or more of the preceding embodiments, the propylene glycol, vegetable glycerin, or combinations thereof comprises less than 50% w/w of the composition, or less than 20% w/w of the composition in other embodiments, or less than 10% w/w of the composition, still other embodiments, or less than 1% w/w of the composition, yet other embodiments, or the humectant is free of one or more of propylene glycol and vegetable glycerin in still yet other embodiments. In embodiments, the humectant is free of both propylene glycol and vegetable glycerin, but an alternative humectant is present.

In embodiments, there are provided compositions comprising an alginate, a tobacco material, and an alginate crosslinker. As described above, alginate may be provided as a salt form prior to crosslinking. In embodiments, the alginate crosslinker comprises a divalent cation. In embodiments, the divalent cation is an alkaline earth metal. In other embodiments, the divalent cation is a transition metal of oxidation state (II), such as zinc or iron. In embodiments the alginate crosslinker comprises calcium ion. In embodiments, the crosslinker comprises chitosan.

In embodiments, an alginate based gellant system may have a concentration of tobacco material may be a non-zero amount up to about 90 w/w %. In embodiments, tobacco material may have a concentration from about 0.1% w/w % to about 20 w/w %. In embodiments, nicotine or salt thereof derived from the tobacco material may be present in an amount from about 1% w/w to about 5% w/w of the gel composition. In embodiments, nicotine from the tobacco material may be present from about 0.5% to about 1.5% w/w of the gel composition. Particular concentrations of nicotine can be tuned by use of particular amounts of tobacco material for delivery of precise amounts of nicotine to a user when the composition is heated in an electronic vapor device. In embodiments, the nicotine or salt thereof derived from the tobacco material may be present at about 1% w/w of the gel composition, or about 2%, or about 3%, or about 5%, or about 10%, or about 15%, or about 20%, or about 25%, or about 30%, or about 35%, or about 40%, or about 45%, or about 50% w/w, including any value in between and fractions thereof. In embodiments, the nicotine or salt thereof derived from the tobacco material may be present in an amount from about 1% w/w/ to 10% w/w of the gel composition, or about 10% w/w to about 20% w/w of the gel composition, or about 20% w/w to about 30% w/w of the gel composition, or 30% w/w to about 40% of the gel composition, or about 40% w/w to about 50% w/w of the gel composition, including any sub-range in between and fractions thereof.

In embodiments, the alginate-based composition may take the form of macroscopic beads. In some such embodiments, the macroscopic beads have a diameter from about 100 microns to about 3 mm. The size of the bead may be readily tailored to any desired size according to reaction conditions including, without limitation, concentration of reagents, reaction temperature and mode of reagent mixing. As indicated in FIG. 1, beads may be accessed by adding solutions of sodium alginate (for example) to a solution of crosslinker, such as calcium chloride. FIG. 1 shows a proposed structural organization of the polysaccharide bound to calcium ion. Other divalent metal ions may exhibit similar structural organization.

As with the cellulose based composition, the alginate compositions may also comprise a humectant. In embodiments of the alginate compositions, the humectant comprises propylene glycol, vegetable glycerin, or combinations thereof. In embodiments, the propylene glycol, vegetable glycerin, or combinations thereof comprises less than 50% w/w of the composition, or less than 20% w/w of the composition in embodiments, or less than 10% w/w of the composition in other embodiments, or less than 1% w/w of the composition in still further embodiments. In embodiments, the alginate compositions employ a humectant, but it is free of one or more of propylene glycol or vegetable glycerin. In embodiments, the humectant is free of both propylene glycol and vegetable glycerin.

In embodiments, there are provided compositions made by a process comprising dissolving a crosslinker in water to form a first solution, dissolving an alginate in water to form a second solution, adding a drop of the second solution to the first solution to form the bead, wherein the second solution optionally comprises a tobacco material.

Figure 2:
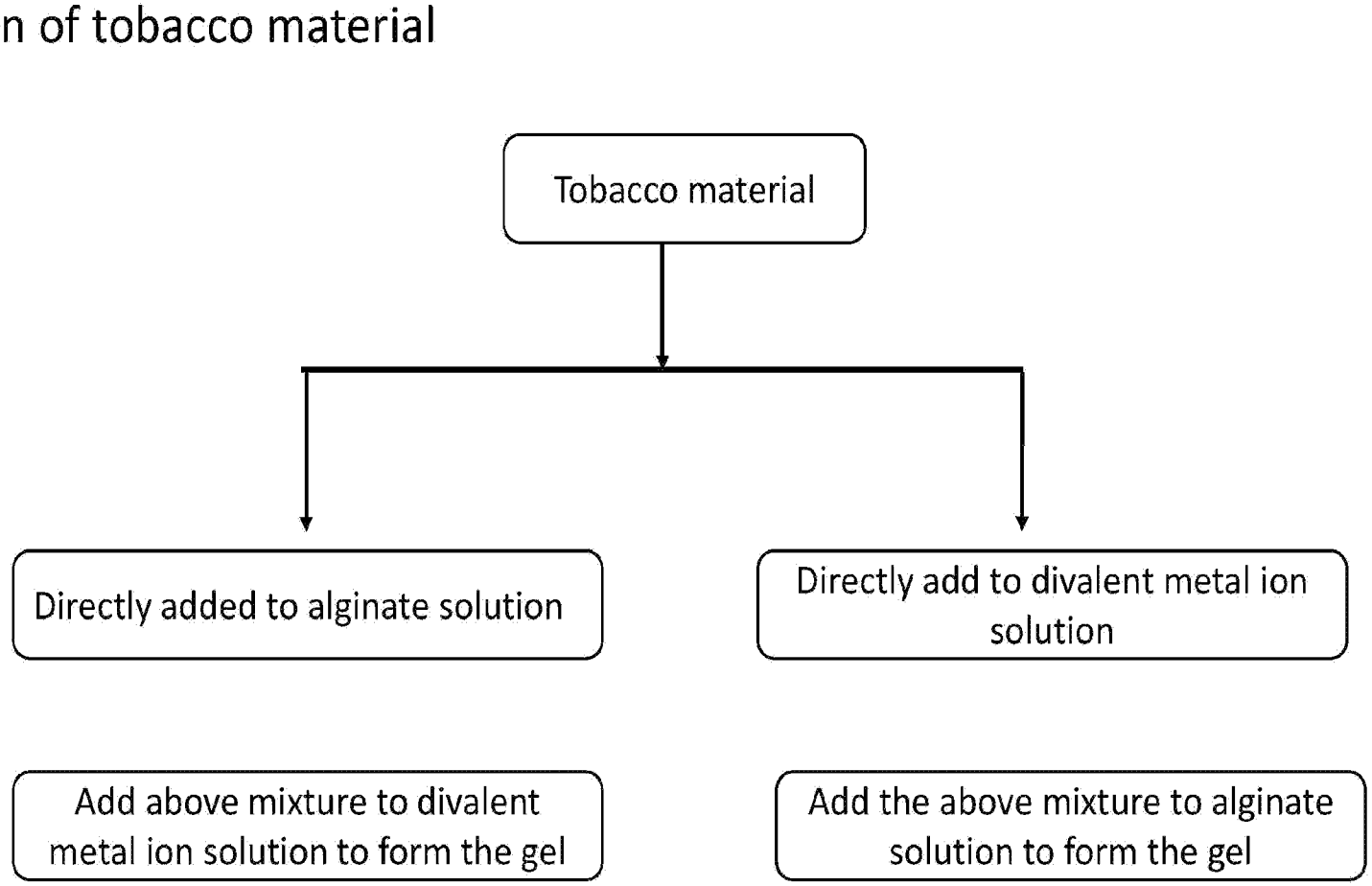
FIG. 2 shows a flow chart of options for incorporation of tobacco material into alginate beads.

In embodiments, the first solution comprises a tobacco material (either as a solution if using an extract, or suspension if using particulate material) along with alginate. In embodiments, the second solution comprises tobacco extract, i.e., the extract is dissolved with the crosslinker. In embodiments, compositions made by the processes herein further comprise loading the bead with tobacco material after the formation of the alginate beads. FIG. 2 summarizes these possibilities in chart form.

In order to facilitate the release or extraction of nicotine from a tobacco material, a hydrated ionic clay may be added to the tobacco material. Without being bound to any particular theory, it is believed that the hydrated ionic clay in the hydrated ionic clay and tobacco material composition facilitates a nicotine exchange process that allows nicotine to be released from the tobacco material. In this manner, nicotine is released from the tobacco material and migrates to a surface of a tobacco material/hydrated ionic clay matrix. The nicotine may be stabilized on the surface of the matrix by hydrogen bonding and/or ionic bonding. Alternately, without bound by the theory, it is possible that tobacco/hydrated ionic clay create acid/base junction in solid phase or pH gradient, and it is possible that the presence of polar solvents such as water could transport nicotine to the intersection of tobacco/hydrated ionic clay from the interior of tobacco. From the surface of the matrix, the nicotine can be extracted into a humectant to form e-liquids, or heated (optionally in presence of humectants) to form an aerosol containing nicotine. The nicotine transport process occurs within the tobacco material/hydrated ionic clay matrix. Also under the basic conditions, bound nicotine is converted to free base nicotine. However, it is understood that protonated and freebase nicotine may exist in equilibrium, and that the composition of each formed inside tobacco is governed by the localized pH. When extracted from the tobacco, the equilibrium of protonated and freebase nicotine dynamically change or switch based on environmental conditions of the tobacco material/hydrated ionic clay matrix and temperature. Increasing the temperature increases the rate of nicotine release from tobacco material/hydrated ionic clay matrix, as well as increasing the rate of extraction of the nicotine into the humectant. The addition of water can facilitate the nicotine/ion exchange process and release of nicotine to the surface of the matrix. The addition of water can also facilitate the release of nicotine from the tobacco material at lower temperatures as compared to the absence of added water. However, the mobility of the nicotine release may be impacted by structured water versus free water differently.

In embodiments, the composition comprises a hydrated ionic clay and a tobacco material. The composition can comprise the hydrated ionic clay in an amount between 1 wt % to 5 wt % of the composition, and any subranges therebetween. The composition can comprise the hydrated ionic clay in an amount between 1 wt % to 4 wt % of the composition, and any subranges therebetween. The composition can comprise the hydrated ionic clay in an amount between 1 wt % to 5 wt % of the composition, and any subranges therebetween. The composition can comprise the hydrated ionic clay in an amount between 1 wt % to 2 wt % of the composition, and any subranges therebetween. The composition can comprise the hydrated ionic clay in an amount between 0.1 wt % to 5 wt % of the composition, and any subranges therebetween. The composition can comprise the hydrated ionic clay in an amount between 0.1 wt % to 10 wt % of the composition, and any subranges therebetween. The composition can comprise the tobacco material in an amount between 40 wt % to 99 wt % of the composition, and any subranges therebetween. The composition can comprise the tobacco material in an amount between 40 wt % to 90 wt % of the composition, and any subranges therebetween. The composition can comprise the tobacco material in an amount between 40 wt % to 80 wt % of the composition, and any subranges therebetween. The composition can comprise the tobacco material in an amount between 40 wt % to 70 wt % of the composition, and any subranges therebetween. The composition can comprise the tobacco material in an amount between 40 wt % to 60 wt % of the composition, and any subranges therebetween. The composition can comprise the tobacco material in an amount between 40 wt % to 50 wt % of the composition, and any subranges therebetween. The composition can comprise the tobacco material in an amount between 50 wt % to 90 wt % of the composition, and any subranges therebetween. The composition can comprise the tobacco material in an amount between 50 wt % to 80 wt % of the composition, and any subranges therebetween. The composition can comprise the tobacco material in an amount between 50 wt % to 70 wt % of the composition, and any subranges therebetween. The composition can comprise the tobacco material in an amount between 50 wt % to 60 wt % of the composition, and any subranges therebetween. The composition can comprise the tobacco material in an amount between 80 wt % to 99 wt % of the composition, and any subranges therebetween. The composition can comprise the tobacco material in an amount between 90 wt % to 99 wt % of the composition, and any subranges therebetween. In embodiments, the composition further comprises water. The composition can comprise the water in an amount between 5 wt % to 50 wt % of the composition, and any subranges therebetween. The composition can comprise the water in an amount between 5 wt % to 40 wt % of the composition, and any subranges therebetween. The composition can comprise the water in an amount between 5 wt % to 30 wt % of the composition, and any subranges therebetween. The composition can comprise the water in an amount between 5 wt % to 20 wt % of the composition, and any subranges therebetween. The composition can comprise the water in an amount between 5 wt % to 15 wt % of the composition, and any subranges therebetween. The composition can comprise the water in an amount between 10 wt % to 40 wt % of the composition, and any subranges therebetween. The composition can comprise the water in an amount between 10 wt % to 30 wt % of the composition, and any subranges therebetween. The composition can comprise the water in an amount between 10 wt % to 20 wt % of the composition, and any subranges therebetween. The composition can comprise the water in an amount between 10 wt % to 15 wt % of the composition, and any subranges therebetween. The composition can comprise the water in an amount between 1 wt % to 10 wt % of the composition, and any subranges therebetween. The composition can comprise the water in an amount between 1 wt % to 5 wt % of the composition, and any subranges therebetween. The composition can comprise the water in an amount between 0.1 wt % to 10 wt % of the composition, and any subranges therebetween. The composition can comprise the water in an amount between 2 wt % to 6 wt % of the composition, and any subranges therebetween. The composition can comprise the hydrated ionic clay and the tobacco material in any of the aforementioned amounts, except in combinations where such amounts are mutually exclusive. The composition can comprise the hydrated ionic clay, the tobacco material, and water in any of the aforementioned amounts, except in combinations where such amounts are mutually exclusive.

In embodiments, the composition comprises a hydrated ionic clay, a tobacco material, and water. The composition can comprise the hydrated ionic clay in an amount between 1 wt % to 5 wt %, the tobacco material in an amount between 40 wt % to 99 wt %, and the water in an amount between 5 wt % to 50 wt % of the composition. The composition can comprise the hydrated ionic clay in an amount between 1 wt % to 4 wt %, the tobacco material in an amount between 50 wt % to 90 wt %, and the water in an amount between 5 wt % to 40 wt % of the composition. The composition can comprise the hydrated ionic clay in an amount between 1 wt % to 3 wt %, the tobacco material in an amount between 60 wt % to 90 wt %, and the water in an amount between 5 wt % to 30 wt % of the composition. The composition can comprise the hydrated ionic clay in an amount between 1 wt % to 3 wt %, the tobacco material in an amount between 50 wt % to 90 wt %, and the water in an amount between 10 wt % to 30 wt % of the composition.

In embodiments, the hydrated ionic clay is a synthetic layered material carrying either a negative charge or a positive charge. The hydrated ionic clay can be an anionic layered alkaline clay. The hydrated ionic clay can comprise silicates. The hydrated ionic clay can comprise alkali and/or alkaline earth metal silicates. The hydrated ionic clay can be a magnesium silicate clay. The hydrated ionic clay can be a sodium magnesium silicate clay. The hydrated ionic clay can be a synthetic trioctahedral clay mineral. The hydrated ionic clay comprises aluminates, titanates and/or zirconates. The hydrated ionic clay can be an aluminate, such as layered double hydroxide carrying net positive charge. The hydrated ionic clay can be a synthetic phyllosilicate. The synthetic phyllosilicate can be a lithium magnesium sodium orthosilicate. The hydrated ionic clay can comprise phosphates. The synthetic phyllosilicate can be an inorganic composition comprising hydrogen, lithium, magnesium, sodium, oxygen, and silicon. The inorganic composition is dilithium; hexadecamagnesium; disodium; 1,3,5,7-tetraoxido-2,4,6,8,9,10-hexaoxa-1,3,5,7-tetrasilatricyclo[3.3.1.13,7]decane; dodecahydroxide. The hydrated ionic clay can include an additive within the clay matrix. The hydrated ionic clay can be Laponite. Laponite, also known as hectorite, is a synthetic, colloidal, layered silicate manufactured from naturally occurring minerals. Laponite, an inorganic polymer, has higher gelling strength and can hold more tobacco material than natural clays. Laponite is available in multiple different grades. The hydrated ionic clay is a gel forming grade, e.g. a gel forming grade of Laponite. The hydrated ionic clay is a gel forming grade, e.g. a sol forming grade of Laponite.

Water can be added to the ionic clay to form a hydrated ionic clay. A portion of the water in the hydrated ionic clay can be bound within the crystalline lattice, with any excess water being free moisture. The hydrated ionic clay may have a surface hydroxyl concentration contributing to localized negative charges. Other moieties including silicon oxides may also contribute to the hydrated ionic clay's anionic properties. $Mg^{2+}$, Li+, K+, and Na+ ions may contribute to a localized positive charges, and also serve as exchangeable cations for the hydrated ionic clay. The charged nature and the interlayer space within the hydrated ionic clay can provide for adsorption of organic molecules.

In embodiments, the tobacco material includes one or more types of tobacco. The tobacco material can be a single type of tobacco or a blend. Any variety of tobacco can be used including, but not limited to, Aromatic Fire-cured, Brightleaf, Burley, Cavendish, Corojo, Criollo, Dokha, Ecuadorian Sumatra, Habano, Kasturi, Latakia, Maduro, Oriental, Perique, Shade, Thuoc lao, Type 22, Virginia, White Burley, Wild, Yl, and the like. The tobacco material may be dry-ice expanded tobacco (DIET), flue-cured tobacco, and/or air-cured tobacco.

In embodiments, the composition is contained within a cartridge. In embodiments, the composition is heated in a device comprising a heating element configured to heat the composition to deliver nicotine or a salt thereof to a user. The device can be an electronic nicotine delivery system.

Figure 3:
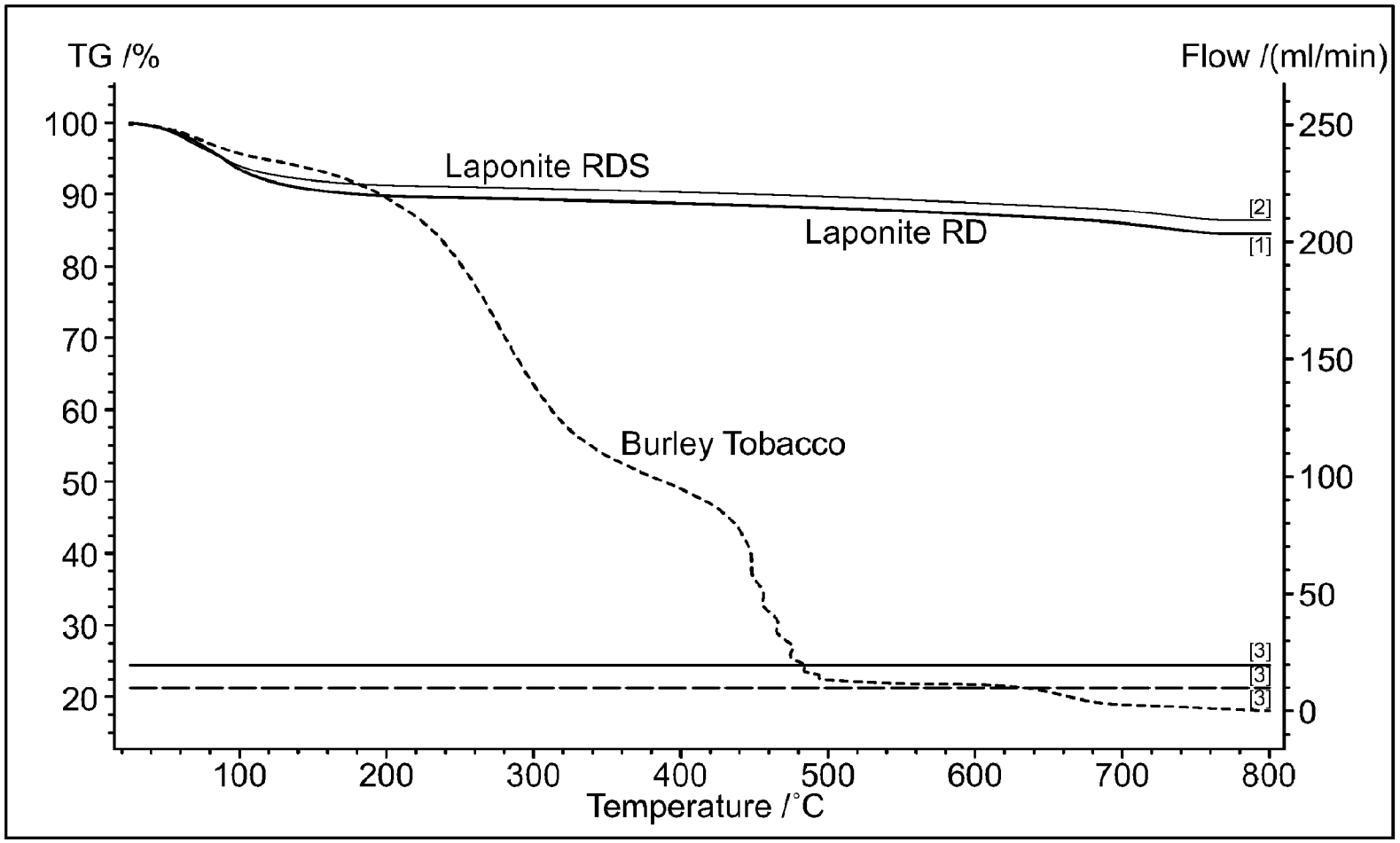
FIG. 3 shows a thermogravimetric plot for heating ionic clays and tobacco material.

FIG. 3 shows a graph of the thermal stability of two grades of Laponite and Burley tobacco material. The initial weight loss at 100° C. of the Laponite is attributable to the loss of the free water. In all, the Laponite loses less than about 10% of its weight up to 600° C., with almost all of the weight loss being water. On the other hand, tobacco loses 60% of its weight before reaching 400° C. Hydrated ionic clays, such as Laponite, are non-flammable and thermally stable at temperatures below 800° C.

In embodiments, the hydrated ionic clay (e.g. Laponite) is gel forming grade the forms a high viscosity colloidal dispersion with water. In embodiments, the hydrated ionic clay is sol forming grade the forms a low viscosity colloidal dispersion with water. While the actual viscosity of the colloidal dispersion depends on the amount of hydrated ionic clay used in the dispersion, the aforementioned high and low viscosity descriptors refer to relative viscosities at a given concentration.

Laponite forms an alkaline dispersion that has a basic pH value, with many of the dispersions having a pH value between 9 and 10. It is believed that all grades of Laponite that have a basic pH can be used in the formulation. However, Laponites could be stabilized to neutral or lower pH by adding acids, for example, to create dispersions having a final pH value of the range from 5 to 12. The acids can be organic acids such as carboxylic acids or inorganic acids such as phosphoric acid.

In embodiments, the tobacco leaves are dried or cured to remove excess moisture and break down chemical compounds. Methods of drying or curing tobacco material include air drying, oven drying, flame-curing, convective drying, vacuum drying, free drying, and combinations thereof. Any type of tobacco material is generally suitable for use according the methods and systems disclosed herein. In embodiments, the tobacco material is a Burley tobacco.

Before use, the hydrated ionic clay is hydrated. For example, a quantity of hydrated ionic clay is measured and added to warm water. The water may be heated to a temperature of 40° C. to 80° C. Heating the water helps the rate at which the hydrated ionic clay disperses in the water. The composition can be mixed by stirring until a uniform dispersion is achieved.

In embodiments, whole tobacco leaves may be coated with hydrated ionic clay. Coating the whole tobacco leaf can be completed before or after the aforementioned drying process. The hydrated ionic clay coating can be applied by a spraying process, contact process (e.g. brushing) or by dipping the leaf in a hydrated ionic clay dispersion. Coating the tobacco leaf with hydrated ionic clay prior to a drying or curing process can avoid multiple drying steps and facilitate the breakdown of chemical compounds. Coating the whole tobacco leaf with hydrated ionic clay can also be accomplished a minimal need for capital investment in equipment. After coating with the hydrated ionic clay, the tobacco leaf can be rolled, cut, pulverized, and/or ground into a powder.

In embodiments, a method of manufacturing a pellet (or other compressed form) containing tobacco material comprises grinding tobacco material to form a powdered tobacco (particle size distribution may range from 50 to 5000 microns) material, mixing a hydrated ionic clay with a first amount of water to form a first dispersion, mixing the powdered tobacco material with the first dispersion to form a second dispersion, evaporating a portion of the first amount of water from the second dispersion to form a loose cake, and compressing the loose cake to form the pellet containing tobacco material. In an initial step, the tobacco leaves are ground to form a powdered tobacco material. In embodiments, the tobacco leaves coated with hydrated ionic clay are ground to form a powdered tobacco material and hydrated ionic clay composition. Grinding increases the surface area of the tobacco material and aids in the nicotine release and extraction process. In embodiments, the tobacco material is finely ground so that the resulting powder passes through a 5 mm mesh sieve. In embodiments, the tobacco material is finely ground so that the resulting powder passes through a 4 mm mesh sieve. In embodiments, the tobacco material is finely ground so that the resulting powder passes through a 3 mm mesh sieve. In embodiments, the tobacco material is finely ground so that the resulting powder passes through a 2 mm mesh sieve. In embodiments, the tobacco material is finely ground so that the resulting powder passes through a 1 mm mesh sieve. In embodiments, the tobacco material is finely ground so that the resulting power passes through a 0.5 mm mesh sieve. In embodiments, the tobacco material is finely ground so that the resulting powder has a particle size in the range of 50 microns to 2000 microns. In embodiments, the tobacco material is finely ground so that the resulting powder has a particle size in the range of 100 microns to 300 microns.

Hydrated ionic clay is mixed with a first amount of water to form a first dispersion/hydrogel, and then the powdered tobacco material is added and mixed to form a second dispersion. The first dispersion can have an adjusted pH value of between 5 and 12. The first dispersion can have a pH value of between 9 and 11. The first dispersion can have a pH value of between 9 and 10. The first amount of water can be heated, for example to a temperature of 40° C. to 80° C. Mixing the hydrated ionic clay with the first amount of water can includes stirring the first dispersion until uniform.

The second dispersion of hydrated ionic clay, water, and powdered tobacco material can be mixed until a uniform dispersion is achieved. A ratio of powdered tobacco material to the hydrated ionic clay in the second dispersion can be greater than 1 to 1. A ratio of powdered tobacco material to the hydrated ionic clay in the second dispersion can be greater than 2 to 1. A ratio of powdered tobacco material to the hydrated ionic clay in the second dispersion can be from 1 to 1 to 15 to 1, including any subrange therebetween.

After mixing, a portion of the water is removed from the second dispersion. In embodiments, heat is used to evaporate water from the second dispersion. In embodiments, a vacuum over is used to evaporate water from the second dispersion. In embodiments, a filter is used to remove excess water. In embodiments, a centrifuge is used to remove excess water. In embodiments, freeze drying can be used to remove excess water. In embodiments, combinations of filtering, centrifugation, and/or heating are used to remove excess water.

After removing a portion of the excess water, a loose cake is formed. In embodiments, the loose cake can be compressed to form a pellet. In embodiments, the press is a hand press, a tablet press, a punch press, a stamping press, a fly press, hydraulic press, manual press, or other suitable compressive device. After pressing, the pellet, it is removed from the press.

The pellet can optionally be further dried using the methods discussed above concerning drying the tobacco. The pellet can optionally be humidified to achieve the desired moisture content. In embodiments, the pellet has a moisture content of about 10 wt % to about 40 wt %. In embodiments, the pellet has a moisture content of about 15 wt % to about 40 wt %. In embodiments, the pellet has a moisture content of about 20 wt % to about 40 wt %. In embodiments, the pellet has a moisture content of about 30 wt % to about 40 wt %. In embodiments, the pellet has a moisture content of about 10 wt % to about 35 wt %. In embodiments, the pellet has a moisture content of about 10 wt % to about 30 wt %. In embodiments, the pellet has a moisture content of about 10 wt % to about 25 wt %. In embodiments, the pellet has a moisture content of about 10 wt % to about 20 wt %. In embodiments, the pellet has a moisture content of about 15 wt % to about 35 wt %. In embodiments, the pellet has a moisture content of about 20 wt % to about 30 wt %. In embodiments, the pellet has a moisture content of about 5 wt % to about 10 wt %. In embodiments, the pellet has a moisture content of less than about 10 wt %. In embodiments, the pellet has a moisture content of about 1 wt % to about 10 wt %.

In embodiments, a method of extracting nicotine from tobacco material comprises contacting tobacco material with a hydrated ionic clay to form a composition, and contacting the composition with a solvent to extract the nicotine from the tobacco material. The solvent can be an organic solvent. The solvent can be a humectant. For example, the solvent can be a solution of propylene glycol and/or vegetable glycerin. The solvent can contain water.

The pellet is immersed in a first solution (i.e. a humectant solution) including a glycol and a glycerol. In embodiments, the first solution has a pH value of between 3 and 7. In embodiments, the first solution has a pH value of between 4 and 6.5. In embodiments, the first solution has a pH value of between 5 and 6. In embodiments, the first solution comprises a ratio of vegetable glycerin (VG) to propylene glycol (PG). The ranges of the ratio can vary between a ratio of about 100:0 VG to PG and a ratio of about 50:50 vegetable glycerol to propylene glycol. The ranges of the ratio can also vary between a ratio of about 50:50 vegetable glycerol to propylene glycol and a ratio of about 0:100 VG to PG. The difference in preferred ratios within the above stated ranges may vary by as little as 1, for example, said ratio may be about 99:1 vegetable glycerol to propylene glycol. However, more commonly said ratios would vary in increments of 15, for example, about 95:5 vegetable glycerol to propylene glycol; or about 85:15 vegetable glycerol to propylene glycol; or about 70:30 vegetable glycerol to propylene glycol; or about 55:45 vegetable glycerol to propylene glycol; or about 40:60 vegetable glycerol to propylene glycol; or about 25:75 vegetable glycerol to propylene glycol; or about 10:90 vegetable glycerol to propylene glycol. In preferred implementations, the first solution will be between the ratios of about 30:70 vegetable glycerol to propylene glycol, or about 70:30 vegetable glycerol to propylene glycol. The blends with varying ratios are selected for consumers with varying preferences, and based on the vaporization device.

Water can be added to the first solution to form a second solution, which is also a humectant solution. Without being bounded to any particular theory, it is believed that water helps drive the release of nicotine from the pellet and into the solution. The hydrated ionic clay in water has a pH value in the range of about 8 to about 12. By adding a small amount of water to the second solution containing the pellet, the water contacts the pellet to increase the localized pH of the hydrated ionic clay in contact with the powered tobacco material. In this manner, the nicotine in the pellet is released and extracted under a localized acidic/basic condition and then mixes into the second solution. The added water may also help transport the nicotine to the surface of the pellet where it can mix with the solution or a gel matrix surrounding it, the heating of which may release nicotine aerosols.

In embodiments, the second solution has a pH value of between 5 and 7. In embodiments, the second solution has a pH value of between 5 and 6. In embodiments, the second solution has a pH value of between 6 and 7.

After a desired amount of nicotine is extracted from the pellet, the second solution can be used as a vaporizable material in a vaporization device. In embodiments, flavorings can be added to the vaporizable material. These flavorings may include enhancers comprising cocoa solids, licorice, tobacco or botanical extracts, and various sugars, to name but a few. In embodiments, acids can be added to the vaporizable material. These acids may include carboxylic acids such as benzoic acid, pyruvic acid, salicylic acid, levulinic acid, malic acid, maleic acid, lactic acid, succinic acid, citric acid, and combinations thereof.

Composition Preparation

In embodiments, a general process for preparing compositions herein comprising aqueous-based gellant systems comprises adding tobacco material to a polysaccharide and adding a gel modifier to form a gellant system. As is evident from the cellulose and alginate examples, the forms of the products may be different and the ordering of reagents may be varied, but the basic principles of the process are shared. Accordingly, in embodiments, the timing of when the tobacco material is added may be flexible. It can be added to the polysaccharide, followed by gel formation, or the tobacco material can be added after or even during the gelation process.

Cartridge

In embodiments, there are provided cartridges for use in a device for releasing nicotine or salt thereof, the cartridge comprising the compositions disclosed herein.

The cartridges may have a variety of configurations depending on the form that the composition. For example, the configurations of the cartridges may vary depending on whether the composition is rendered in the form beads, films, solid gel mass, and the like. In general, the cartridge can comprise a food-safe material. Cartridges can be made from a variety of materials including, but not limited to, metals, rigid plastics, flexible plastics, paper, paperboard, cardboard, and wax paper. Examples of some food-safe materials include aluminum, stainless steel, polyethylene terephthalate (PET), amorphous polyethylene terephthalate (APET), high density polyethylene (HDPE), polyvinyl chloride (PVC), low density polyethylene (LDPE), polypropylene, polystyrene, polycarbonate, and many varieties of paper products. In some cases, especially when the material is paper, the cartridge shell can be lined with a material or a food-safe material to prevent both drying of composition and to protect it from environmental degradation.

In practice, the cartridge is configured to integrate with a device for inhalation of nicotine or nicotine-containing vapor by a subject. In embodiments, the cartridge is formed and shaped for easy insertion into a heating chamber of a device. Moreover, the cartridge is formed and shaped to snugly fit into the cavity of the heating chamber for improved thermal conduction to heat the compositions in the cartridge.

The cartridge can be equipped with a lid, a cover, or a surface seal (e.g., a heat-sealable lidding film) configured to fully enclosed and hermetically seal the cartridge. A sealed cartridge can have the advantage of preserving freshness of the contents and preventing spill of the materials within the cartridge during shipment or handling by the user.

In embodiments, a cartridge can be designed to be disposable and is thus suitable for a single use. In other embodiments, a cartridge can be configured to be reusable such that the same cartridge can be used and/or refilled multiple times. A cartridge can be provided (or sold to an end user) containing a single dose or multiple doses of a composition as disclosed herein. The type of product contained within the cartridge can be stamped or written on the cartridge, or indicated by the color, size, or shape of the cartridge. Alternatively, the cartridge can include circuitry implementing memory (e.g., electrically erasable programmable read-only memory (EEPROM) and/or the like) for storing at least a portion of the information identifying the contents of the cartridge. In embodiments, a cartridge can be filled and/or refilled by an end used with the compositions disclosed herein as well.

Device

The compositions disclosed herein may be used with a device that allows the user to inhale an aerosol, colloquially referred to as "vapor," which can be generated by a heating element that vaporizes some portion of the compositions disclosed herein. The compositions may be provided within a cartridge (e.g., a separable part of the vaporizer device that contains the compositions) that includes an outlet (e.g., a mouthpiece) for inhalation of the aerosol by a user. In other embodiments, the compositions may be provided as part of a heating element in a device that requires no cartridge.

To receive the inhalable aerosol generated by a device, a user may, in certain examples, activate the device by taking a puff, by pressing a button, and/or by some other approach. A puff as used herein can refer to inhalation by the user in a manner that causes a volume of air to be drawn into the device such that the inhalable aerosol is generated by combining the volume of air with a vaporizable portion of the compositions disclosed herein.

In embodiments there are provided devices comprising a heating element configured to heat the compositions herein, to deliver nicotine or salt thereof to a user. In embodiments, the composition is disposed proximate to a heating element, thereby allowing heating of the composition from the inside of the gel material. In embodiments, the compositions disclosed herein may be disposed conformally about any shaped heating element including, without limitation, coils, rods, foils and tapes, porous tapes, porous foils, tapes with printed resistive heating elements, mesh material and the like to allow, in embodiments, the gel to be heated from the inside.

In embodiments, the compositions disclosed herein may be in surface contact with a heating element of a device to deliver nicotine or salt thereof to the user. For example, where the gellant system comprises beads, a device may be configured to deliver/dispense individual beads or a dose of a fixed number of beads to a heating element. Alternatively, the device may be configured to heat individual beads or groups of beads disposed in an array wherein heating is spatially addressable based on the number of uses. In embodiments, the composition may be in any shape, not just bead form. In embodiments, the compositions disclosed herein can be deposited onto a roll or film and heated through conductive, convective, inductive, and radiative heating methods.

EMBODIMENTS

In embodiments, a composition includes an aqueous polysaccharide-based gellant system, which includes a polysaccharide and a gel modifier, and a tobacco material.

In embodiments, a composition includes an aqueous polysaccharide-based gellant system, which includes a polysaccharide and a gel modifier, a hydrated ionic clay, and a tobacco material.

In embodiments, the hydrated ionic clay may be present in a range from about 1 wt % to about 10 wt % of the composition.

In embodiments, the hydrated ionic clay is between 1 wt % to 4 wt % of the composition.

In embodiments, the hydrated ionic clay is between 1 wt % to 3 wt % of the composition.

In embodiments, the hydrated ionic clay is between 1 wt % to 2 wt % of the composition.

In embodiments, the tobacco material is between 5 wt % to 95 wt % of the composition.

In embodiments, the tobacco material is between 40 wt % to 90 wt % of the composition.

In embodiments, the tobacco material is between 40 wt % to 80 wt % of the composition.

In embodiments, the tobacco material is between 40 wt % to 60 wt % of the composition.

In embodiments, the tobacco material is between 40 wt % to 50 wt % of the composition.

In embodiments, the tobacco material is between 50 wt % to 90 wt % of the composition.

In embodiments, the tobacco material is between 50 wt % to 80 wt % of the composition.

In embodiments, the tobacco material is between 50 wt % to 70 wt % of the composition.

In embodiments, the tobacco material is between 50 wt % to 60 wt % of the composition.

In embodiments, the tobacco material is between 80 wt % to 95 wt % of the composition.

In embodiments, the tobacco material is between 90 wt % to 95 wt % of the composition.

In embodiments, water is present between 5 wt % to 90 wt % of the composition.

In embodiments, the water is between 5 wt % to 40 wt % of the composition.

In embodiments, the water is between 5 wt % to 30 wt % of the composition.

In embodiments, the water is between 5 wt % to 20 wt % of the composition.

In embodiments, the water is between 5 wt % to 15 wt % of the composition.

In embodiments, the water is between 10 wt % to 40 wt % of the composition.

In embodiments, the water is between 10 wt % to 30 wt % of the composition.

In embodiments, the water is between 10 wt % to 20 wt % of the composition.

In embodiments, the water is between 10 wt % to 15 wt % of the composition.

In embodiments, compositions may further comprise a humectant, wherein the humectant is between 1 wt % to 40 wt % of the composition.

In embodiments, the humectant comprises propylene glycol, vegetable glycerin, or combinations thereof.

In embodiments, the propylene glycol, vegetable glycerin, or combinations thereof comprises less than about 50% w/w of the composition.

In embodiments, the propylene glycol, vegetable glycerin, or combinations thereof comprise less than 20% w/w of the composition.

In embodiments, the propylene glycol, vegetable glycerin, or combinations thereof comprise less than 10% w/w of the composition.

In embodiments, the propylene glycol, vegetable glycerin, or combinations thereof comprise less than 1% w/w of the composition.

In embodiments, the humectant is free of one or more of propylene glycol and vegetable glycerin.

In embodiments, the humectant is free of both propylene glycol and vegetable glycerin.

In embodiments, the hydrated ionic clay is an anionic layered alkaline clay. We can neutralize hydrate anionic clay to 6.5 to 7.0 in the final form, it may still work In embodiments, the hydrated ionic clay comprises silicates.

In embodiments, the hydrated ionic clay comprises aluminates, titanates, and/or zirconates.

In embodiments, the hydrated ionic clay comprises phosphates.

In embodiments, the hydrated ionic clay comprises alkali and/or alkaline earth metal silicates.

In embodiments, the hydrated ionic clay comprises layered double hydroxides.

In embodiments, the hydrated ionic clay is a synthetic trioctahedral clay mineral.

In embodiments, the hydrated ionic clay is a synthetic phyllosilicate.

In embodiments, the synthetic phyllosilicate is a lithium magnesium sodium orthosilicate.

In embodiments, the synthetic phyllosilicate is an inorganic composition comprising hydrogen, lithium, magnesium, sodium, oxygen, and silicon.

In embodiments, the inorganic composition is dilithium; hexadecamagnesium;disodium;1,3,5,7-tetraoxido-2,4,6,8,9,10-hexaoxa-1,3,5,7-tetrasilatricyclo[3.3.1.13,7]decane; dodecahydroxide.

In embodiments, the hydrated ionic clay is Laponite.

In embodiments, the hydrated ionic clay is a gel forming grade.

In embodiments, the hydrated ionic clay is a sol forming grade.

In embodiments, the tobacco material is a pure tobacco or a tobacco blend.

In embodiments, the tobacco material is at least one of Burley, Virginia, Kasturi, Oriental, and combinations thereof.

In embodiments, compositions may further comprise an organic acid.

In embodiments, compositions may further comprise a flavoring agent.

In embodiments, the polysaccharide is selected from the group consisting of an alginic acid, a cellulose, a guar (galactomannan), a xanthan gum, an agar, a gellan, an amylose, a welan gum, a rhamsan, a carrageenan, a chitosan, a scleroglucan, a diutan gum, a pectin, a starch, derivatives thereof, and combinations thereof.

In embodiments, the cellulose is selected from the group consisting of cellulose, methyl cellulose, ethyl cellulose, ethyl methyl cellulose, hydroxyethyl cellulose, hydroxypropyl cellulose, hydroxyethyl methyl cellulose, hydroxypropyl methyl cellulose, ethyl hydroxyl ethyl cellulose, carboxymethyl cellulose, carboxymethylhydroxyethyl cellulose, cellulose sulfate, cellulose acetate, and combinations thereof.

In embodiments, the guar is selected from the group consisting of natural guar, hydroxypropylguar (HPG), sulfonated guar, sulfonated hydroxypropylguar, carboxymethyl hydroxypropyl guar (CMHPG), carboxymethylguar.

In embodiments, the alginic acid is selected from the group consisting of sodium alginate, ammonium alginate, and potassium alginate.

In embodiments, the gel modifier comprises a crosslinker.

In embodiments, the crosslinker comprises a divalent or trivalent metal cation.

In embodiments, the crosslinker comprises an alkaline earth metal.

In embodiments, the crosslinker comprise a borate, a titanate, a calcium ion, an aluminum ion, a copper ion, a zinc ion, a zirconium ion, a magnesium ion, and combinations thereof.

In embodiments, the gel modifier comprises a water-soluble polymer.

In embodiments, the water soluble polymer is selected from the group consisting of a polyether, a polyvinylpyrrolidone, a polyvinyl alcohol, a polyacrylic acid, a polyacrylamide, a polyoxazoline, a polyphosphate, and an albumin.

In embodiments, the gellant system is provided in the form of macroscopic beads.

In embodiments, the macroscopic beads are a shell encapsulating a solution of the tobacco material.

In embodiments, the macroscopic beads are solid and the tobacco material is disposed within the gellant system.

In embodiments, the gellant system is provided in the form of a film.

In embodiments, the gellant system is provided as a solid mass.

In embodiments, the gellant system is provided as a plurality of particles of a size in a range from about 1 micron to about 1 mm.

In embodiments, the gellant system reversibly forms a fluid liquid on heating and reforms the gellant system on cooling.

In embodiments, there are provided compositions comprising a cellulose matrix, a tobacco material, and a water-soluble polymer.

In embodiments, compositions may further comprise a hydrated ionic clay.

In embodiments, the tobacco material is disposed within the cellulose matrix, within the hydrated ionic clay, or both.

In embodiments, the water-soluble polymer is disposed about the cellulose matrix.

In embodiments, the cellulose matrix is selected from the group consisting of cellulose, methyl cellulose, ethyl cellulose, ethyl methyl cellulose, hydroxyethyl cellulose, hydroxypropyl cellulose, hydroxyethyl methyl cellulose, hydroxypropyl methyl cellulose, ethyl hydroxyl ethyl cellulose, carboxymethyl cellulose, carboxymethylhydroxyethyl cellulose, cellulose sulfate, cellulose acetate, and combinations thereof.

In embodiments, the composition is particulate having an effective diameter from about 1 micron to about 1 mm.

In embodiments, the composition is particulate having an effective diameter from about 1 micron to about 10 microns.

In embodiments, the water-soluble polymer is a polyether.

In embodiments, the water-soluble polymer is selected from the group consisting of polyethylene glycol (PEG), a block copolymer of PEG and polypropylene glycol (PPG), and combinations thereof.

In embodiments, the water-soluble polymer comprises a polyvinylpyrrolidone.

In embodiments, the water-soluble polymer has a number average molecular weight (Mn) from about 5,000 daltons to about 30,000 daltons.

In embodiments, the water soluble polymer has a number average molecular weight (Mn) from about 10,000 daltons to about 20,000 daltons.

In embodiments, a ratio of the cellulose matrix to the water-soluble polymer is in a range from about 10:1 to about 1.5:1.

In embodiments, a ratio of the cellulose matrix to the water-soluble polymer is in a range from about 5:1 to about 2:1.

In embodiments, the composition further comprises a humectant.

In embodiments, the humectant comprises propylene glycol, vegetable glycerin, or combinations thereof.

In embodiments, the propylene glycol, vegetable glycerin, or combinations thereof comprises less than 50% w/w of the composition.

In embodiments, the propylene glycol, vegetable glycerin, or combinations thereof comprise less than 20% w/w of the composition.

In embodiments, the propylene glycol, vegetable glycerin, or combinations thereof comprise less than 10% w/w of the composition.

In embodiments, the propylene glycol, vegetable glycerin, or combinations thereof comprise less than 1% w/w of the composition.

In embodiments, the humectant is free of one or more of propylene glycol and vegetable glycerin.

In embodiments, the humectant is free of both propylene glycol and vegetable glycerin. Other humectants include, without limitation, polyethylene glycols, triethylene glycol, tripropylene glycol, polypropylene glycol or polypropylene oxide, triacetin, and sorbitol.

In embodiments, there are provided compositions comprising an alginate, a tobacco material, and an alginate crosslinker.

In embodiments, compositions may further comprise a hydrated ionic clay.

In embodiments, the crosslinker comprises a divalent cation.

In embodiments, the crosslinker comprises an alkaline earth metal ion.

In embodiments, the crosslinker comprises calcium ion.

In embodiments, the crosslinker comprises chitosan.

In embodiments, the composition is in the form of macroscopic beads.

In embodiments, the composition may be 3D printed to any desired geometry.

In embodiments, the macroscopic beads have a diameter from about 100 microns to about 3 mm.

In embodiments, compositions may further comprise a humectant.

In embodiments, the humectant comprises propylene glycol, vegetable glycerin, or combinations thereof.

In embodiments, the propylene glycol, vegetable glycerin, or combinations thereof comprises less than 50% w/w of the composition.

In embodiments, the propylene glycol, vegetable glycerin, or combinations thereof comprise less than 20% w/w of the composition.

In embodiments, the propylene glycol, vegetable glycerin, or combinations thereof comprise less than 10% w/w of the composition.

In embodiments, the propylene glycol, vegetable glycerin, or combinations thereof comprise less than 1% w/w of the composition.

In embodiments, the humectant is free of one or more of propylene glycol or vegetable glycerin.

In embodiments, the humectant is free of both propylene glycol and vegetable glycerin.

In embodiments, there are provided cartridges containing the composition disclosed herein.

In embodiments, there are provided devices comprising a heating element configured to heat the composition disclosed herein to deliver nicotine or a salt thereof to a user.

In embodiments, the device is an electronic nicotine delivery system.

In embodiments, the device is based on combustion or exothermic reactions.

In embodiments, there are provided systems comprising a cartridge containing a composition disclosed herein, and a device comprising a receptacle configured to receive the cartridge.

In embodiments, there are provided methods of delivering nicotine to a user comprising providing a device comprising a heating element configured to heat the compositions disclosed herein, to deliver nicotine or a salt thereof to the user, and activating the heating element.

EXAMPLES

Example 1

This Example shows the extraction of nicotine from tobacco-clay pellets.

Approximately 0.4 g of Laponite (procured from BYK Additives & Instruments) was added to 20 g of distilled deionized water at 60° C. while constantly stirring. Once Laponite was fully dissolved or dispersed, the viscosity of the water significantly increased and eventually formed a sol/gel structure. To 20.4 g sol/gel, 6.0 g of finely powdered Tobacco (Burley, particle size ranging from 100-500 microns), was added and rigorously agitated until a homogeneous dispersion of tobacco with paste like consistency is accomplished. The tobacco particles suspended in gel structure were partially dehydrated (optionally) until the final concentration of the water in the formulation is less than 40% (as determined by Karl Fisher). Partially dried tobacco-Laponite gel matrix containing less than 40% of water was compressed into a cylindrical pellet form using a 1-2-ton press. However, the pellet shape could be altered to any shape or form. Alternately, the pellet form could be directly printed using an XYZ table. The tobacco-Laponite pellets weighing 1.0 g were gently placed into Propylene Glycol, Vegetable Glycerin, and Water mixture (approximate ratio 60:30:10). The release of nicotine from the pellet at room temperature was measured using GC-FID. The nicotine released varied anywhere from 20-99% based on experimental conditions employed (i.e., time, temperature, solvent ratios, and Laponite binder type).

Example 2

This Example shows a method for extraction of nicotine from tobacco from tobacco alginate beads:

Approximately 0.1 g of sodium alginate (Arcos Organics) was added to 20 g of distilled deionized water at 60° C. while constantly stirring. Once it was fully dissolved or dispersed, the viscosity of the water significantly increased and eventually formed a sol/gel structure. To 20.1 g sol/gel, 0.2 g of finely powdered Tobacco (Burley, particle size ranges from 100-500 microns), was added and rigorously agitated until a homogeneous dispersion of tobacco with sol/gel like consistency is accomplished. Another solution was made with calcium chloride (procured from Merck) by adding 1 g to 100 ml of deionized water. The above prepared tobacco dispersion was slowly extruded into calcium chloride solution (crosslinking agent) using a syringe to form spherical beads. However, the extruded gel could be printed on any surface support in any shape or form. The tobacco alginate Laponite beads weighing approximately 0.2 g were gently placed into Propylene Glycol, Vegetable Glycerin, and Water mixture (approximate ratio 60:30:10).

Example 3

This Example shows a method for extraction of nicotine from tobacco-alginate-clay beads:

Approximately 0.1 g of sodium alginate (procured from Arcos organics) was added to 20 g of distilled deionized water at 60° C. while constantly stirring. To this dispersion, 0.1 g of Laponite (procured from BYK Additives & Instruments) was added to the above mixture at constant stirring. Once fully dissolved or dispersed, the viscosity of the water significantly increased and eventually formed a sol/gel structure. To 20.2 g sol/gel, 0.2 g of finely powdered Tobacco (Burley), 100-500 microns, was added and rigorously agitated until a homogeneous dispersion of tobacco with sol/gel like consistency is accomplished. Another solution was made with calcium chloride (procured from Merck) by adding 1 g to 100 ml of deionized water. The above prepared tobacco dispersion was slowly extruded into calcium chloride solution (crosslinking agent) using a syringe to form gel beads (the beads could be printed or altered to any shape or form as required). The tobacco alginate Laponite beads weighing approximately 0.2 g were gently placed into Propylene Glycol, Vegetable Glycerin, and Water mixture (approximate ratio 60:30:10). The release of nicotine from the bead at room temperature was measured using GC-FID. More than 90% of nicotine release was observed and can vary based on the environmental conditions employed.

What is claimed is:

1. A composition comprising:

an aqueous polysaccharide-based gellant system comprising:

a polysaccharide; and a gel modifier, wherein the gel modifier is a water-soluble polymer selected from the group consisting of a poloxamer, a polyether, a polyacrylamide, a polyoxazoline, a polyphosphate, an albumin, and combinations thereof; and a tobacco material;

wherein the polysaccharide comprises a cellulose matrix, the tobacco material is disposed within the cellulose matrix, and the water-soluble polymer encapsulates the cellulose matrix.

2. The composition of claim 1, further comprising a hydrated ionic clay.

3. The composition of claim 2, wherein the hydrated ionic clay is between 1 wt % to 10 wt % of the composition.

4. The composition of claim 3, wherein the hydrated ionic clay is between 1 wt % to 4 wt % of the composition.

5. The composition of claim 4, wherein the hydrated ionic clay is between 1 wt % to 3 wt % of the composition.

6. The composition of claim 5, wherein the hydrated ionic clay is between 1 wt % to 2 wt % of the composition.

7. The composition of claim 1, wherein the tobacco material is between 5 wt % to 95 wt % of the composition.

8. The composition of claim 7, wherein the tobacco material is between 40 wt % to 90 wt % of the composition.

9. The composition of claim 8, wherein the tobacco material is between 40 wt % to 80 wt % of the composition.

10. The composition of claim 9, wherein the tobacco material is between 40 wt % to 60 wt % of the composition.

11. The composition of claim 10, wherein the tobacco material is between 40 wt % to 50 wt % of the composition.

12. The composition of claim 7, wherein the tobacco material is between 50 wt % to 90 wt % of the composition.

13. The composition of claim 12, wherein the tobacco material is between 50 wt % to 80 wt % of the composition.

14. The composition of claim 13, wherein the tobacco material is between 50 wt % to 70 wt % of the composition.

15. The composition of claim 14, wherein the tobacco material is between 50 wt % to 60 wt % of the composition.

16. The composition of claim 7, wherein the tobacco material is between 80 wt % to 95 wt % of the composition.

17. The composition of claim 16, wherein the tobacco material is between 90 wt % to 95 wt % of the composition.

18. The composition of claim 1, wherein water is present between 5 wt % to 90 wt % of the composition.

* * * * *